US009791816B2

(12) United States Patent
Suzuki et al.

(10) Patent No.: US 9,791,816 B2
(45) Date of Patent: Oct. 17, 2017

(54) IMAGE FORMING APPARATUS AND SHEET ACCOMMODATING DEVICE

(71) Applicant: CANON KABUSHIKI KAISHA, Tokyo (JP)

(72) Inventors: Yohei Suzuki, Mishima (JP); Masayoshi Fukatsu, Suntou-gun (JP); Hiroharu Tsuji, Numazu (JP); Genki Takahashi, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/567,936

(22) Filed: Dec. 11, 2014

(65) Prior Publication Data

US 2015/0168900 A1 Jun. 18, 2015

(30) Foreign Application Priority Data

Dec. 17, 2013 (JP) ..... 2013-260386

(51) Int. Cl.
*G03G 15/00* (2006.01)

(52) U.S. Cl.
CPC ..... *G03G 15/5016* (2013.01); *G03G 15/6552* (2013.01); *G03G 15/6573* (2013.01)

(58) Field of Classification Search
CPC ..... G03G 15/5016; G03G 15/5091
USPC ..... 399/81
See application file for complete search history.

(56) References Cited

U.S. PATENT DOCUMENTS 5,308,058 A * 5/1994 Mandel
5,328,169 A * 7/1994 Mandel ..... B65H 39/11 209/534
5,342,034 A * 8/1994 Mandel ..... B42C 1/125 109/56
5,358,238 A * 10/1994 Mandel ..... B65H 31/24 101/2
5,610,724 A * 3/1997 Kaneko ..... G06K 15/00 358/400
5,697,761 A * 12/1997 Morgan
2010/0214585 A1* 8/2010 Tanji ..... G03G 15/6552 358/1.12
2012/0075657 A1* 3/2012 Yamamoto ..... B41J 13/0036 358/1.14
2013/0004195 A1* 1/2013 Kohda ..... H04N 1/00408 399/82

FOREIGN PATENT DOCUMENTS

JP 04048323 A * 2/1992
JP 11-228018 A 8/1999

(Continued)

*Primary Examiner* — Benjamin Schmitt
*Assistant Examiner* — Milton Gonzalez
(74) *Attorney, Agent, or Firm* — Canon U.S.A., Inc. IP Division

(57) ABSTRACT

An image forming apparatus includes an accommodation unit and a display unit. The accommodation unit accommodates a sheet having an image formed thereon. The display unit displays a selection screen that prompts a user to select information concerning a user who has given instructions to the accommodation unit to accommodate a sheet. The display unit displays a predetermined screen that represents a state or function of the image forming apparatus, and switches the predetermined screen to the selection screen on condition that the instructions have been received.

15 Claims, 20 Drawing Sheets

(56) References Cited

FOREIGN PATENT DOCUMENTS

| | | | | |
|---|---|---|---|---|
| JP | 2003-191578 | A | | 7/2003 |
| JP | 2004188795 | A | * | 7/2004 |
| JP | 2009107784 | A | * | 5/2009 |
| JP | 2009-234117 | A | | 10/2009 |
| JP | 2009-262493 | A | | 11/2009 |
| JP | 2013-220905 | A | | 10/2013 |

* cited by examiner

IMAGE FORMING APPARATUS AND SHEET ACCOMMODATING DEVICE

BACKGROUND OF THE INVENTION

Field of the Invention

The present invention relates to an image forming apparatus and a sheet accommodating device which include an accommodation unit that temporarily accommodates sheets having images formed thereon.

Description of the Related Art

In the related art, there are known image forming apparatuses, such as a copying machine and a printer, configured so that a sheet having an image formed thereon is temporarily accommodated in one of a plurality of discharge trays and the accommodated sheet is discharged in accordance with user instructions.

One of such image forming apparatuses having a plurality of discharge trays is disclosed in Japanese Patent Laid-Open No. 2003-191578. In the disclosed image forming apparatus, sheets are sorted into different discharge trays by user. The image forming apparatus has a touch panel, and a user gives instructions using the touch panel to remove a sheet from a discharge tray. Specifically, first, the user touches a Remove button displayed on the touch panel. Then, the screen of the touch panel is changed to a screen that provides the names of users who are currently using the discharge trays. When the user touches the portion of their name displayed on the touch panel, the screen of the touch panel is changed to a confirmation screen including an Execute button and a Cancel button. Pressing the Execute button allows the associated discharge tray to move, so that the user is able to remove the desired printed sheet from the discharge tray.

The configuration disclosed in Japanese Patent Laid-Open No. 2003-191578 requires a user to perform a plurality of operations on the touch panel in order to remove a sheet. This increases the complexity of the operations, resulting in reduced usability.

SUMMARY OF THE INVENTION

In one embodiment, the present invention provides an improvement in usability by displaying screens that vary from one situation to another.

Accordingly, an aspect of the present invention provides an image forming apparatus which includes an accommodation unit configured to accommodate a sheet having an image formed thereon, and a display unit configured to display a selection screen that prompts a user to select information concerning a user who has given instructions to the accommodation unit to accommodate a sheet, wherein the display unit displays a predetermined screen that represents a state or function of the image forming apparatus, and switches the predetermined screen to the selection screen on condition that the instructions have been received.

Further features of the present invention will become apparent from the following description of exemplary embodiments with reference to the attached drawings.

DESCRIPTION OF THE EMBODIMENTS

First Exemplary Embodiment

Some exemplary embodiments of the present invention will be described in detail hereinafter with reference to the drawings.

Configuration Diagram of Image Forming Apparatus

Figure 1:
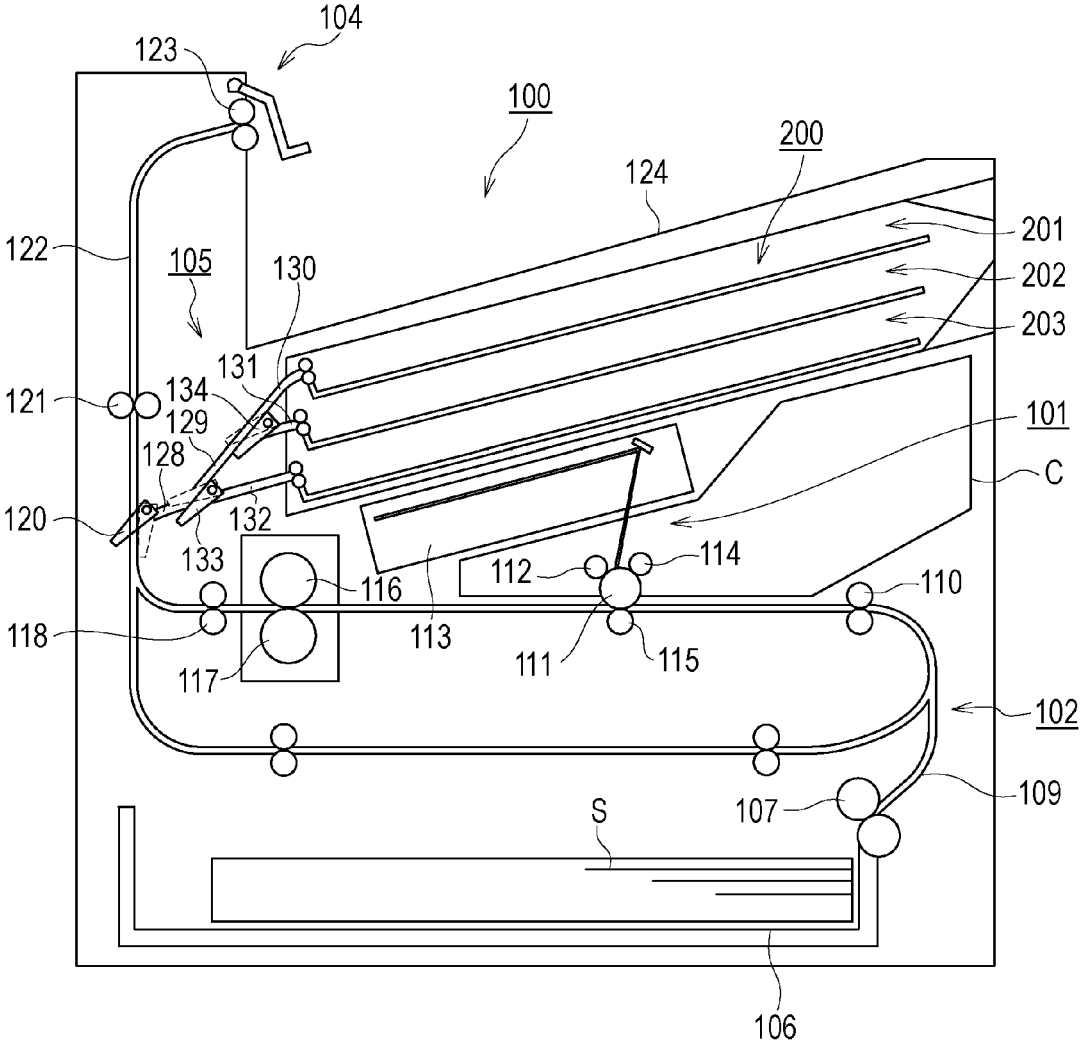
FIG. 1 is a diagram illustrating a configuration of an image forming apparatus according to exemplary embodiments of the present invention.

FIG. 1 is a diagram illustrating a configuration of an image forming apparatus including an accommodation unit according to a first exemplary embodiment of the present invention. In this exemplary embodiment, an image forming apparatus will be described in the context of a laser beam printer, by way of example.

An image forming apparatus 100 includes an image forming unit 101, a supply unit 102 that supplies a sheet S to the image forming unit 101, and a discharge unit 104 that discharges the sheet S after an image has been formed on the sheet S by the image forming unit 101. The sheet S is a medium on which an image is formed by the image forming apparatus 100, examples of which include paper, an overhead projector (OHP) sheet, and cloth. The image forming apparatus 100 further includes a sheet accommodating device 200 including a plurality of accommodation units 201 to 203. The sheet accommodating device 200 is disposed above the image forming unit 101. Each of the plurality of accommodation units 201 to 203 is configured to temporarily accommodate a sheet S having an image formed thereon inside the image forming apparatus 100. The image forming apparatus 100 further includes a conveying unit 105 that conveys the sheet S having an image formed thereon to the sheet accommodating device 200.

The image forming unit 101 includes a photoconductive drum 111 that rotates in a clockwise (CW) direction in FIG. 1, a charging roller 112 that charges a surface of the photoconductive drum 111, and an exposure device 113 that irradiates the photoconductive drum 111 with light to form an electrostatic latent image. The image forming unit 101 further includes a developing device 114 that applies toner to the electrostatic latent image to form a toner image on the photoconductive drum 111, and a transfer roller 115 that transfers the toner image onto a conveyed sheet S. The image forming unit 101 further includes a fixing roller 116, a pressure roller 117 configured to abut against the fixing roller 116, and fixing discharge rollers 118, so that the toner image transferred onto the sheet S is fixed onto the sheet S. The image forming unit 101 performs the electrophotographic image forming process described above to form a toner image on the sheet S. In the image forming apparatus 100 according to this exemplary embodiment, the photoconductive drum 111, the charging roller 112, the developing device 114, and a toner accommodation unit (not illustrated) that accommodates toner are integrally formed into a cartridge C. The cartridge C is removably attachable to the main body of the image forming apparatus 100. When toner is exhausted, the user can replace the cartridge C with a new cartridge C. Accordingly, the user is able to perform the maintenance of the image forming apparatus 100 by themselves without relying on professional maintenance and repair services. In addition, embodiments of the present invention are not limited to the image forming apparatus 100 of the cartridge type described above, and may be applied to a configuration in which members such as the photoconductive drum 111, the charging roller 112, and the developing device 114 are fixedly mounted in the image forming apparatus 100 (which is of a type which does not require replacement of members).

The supply unit 102 includes a supply cassette 106 in which a plurality of sheets S to be used for image forming are stacked on one another and accommodated, supply rollers 107, a conveyance guide 109, and registration rollers 110.

The discharge unit 104 includes a first switching member 120, conveying rollers 121, a discharge guide 122, discharge rollers 123, and a discharge tray 124. The first switching member 120 is configured to be capable of switching between a position indicated by a solid line in FIG. 1 to cause a sheet S having an image formed thereon to move toward the sheet accommodating device 200 and a position indicated by a broken line to cause a sheet S having an image formed thereon to move toward the discharge tray 124, by using an actuator (not illustrated). The discharge tray 124 is disposed on the top surface of the image forming apparatus 100 so that a plurality of users can use the discharge tray 124 in a shared manner. A sheet is discharged onto the discharge tray 124 in such manner (face-down) that a side (front side) on which an image has been formed faces down.

The conveying unit 105 includes a second switching member 133 for switching the conveyance direction of the sheet S, a third switching member 134, and conveyance guides 128 to 132 for guiding the sheet S to the accommodation units 201 to 203. Each of the second switching member 133 and the third switching member 134 is configured to be capable of switching between a position indicated by a solid line in FIG. 1 and a position indicated by a broken line by using an actuator (not illustrated). For example, in order to convey the sheet S to the accommodation unit 201, each of the second switching member 133 and the third switching member 134 is placed at the position indicated by the solid line in FIG. 1. The sheet S travels from the conveyance guide 128, passing through the conveyance guides 129 and 130 in this order, and is conveyed to the accommodation unit 201. In order to convey the sheet S to the accommodation unit 202, the position of only the third switching member 134 is switched to the position indicated by the broken line. In this case, the sheet S travels through the conveyance guides 128, 129, and 131 in this order, and is conveyed to the accommodation unit 202. As in the discharge tray 124, the sheet S is also accommodated in the accommodation units 201 to 203 in a face-down manner.

Configuration Diagram of Sheet Accommodating Device

Figure 2:
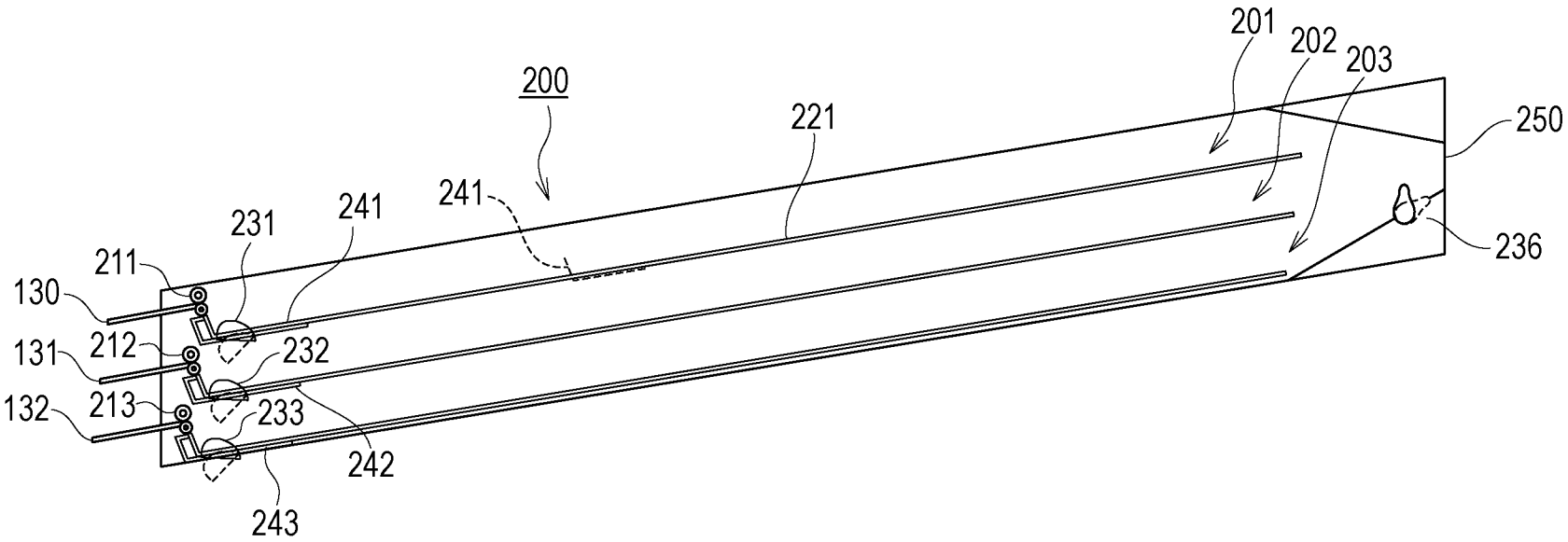
FIG. 2 is a diagram illustrating a configuration of sheet accommodating device according to the exemplary embodiments of the present invention.

FIG. 2 is a diagram illustrating a configuration of the sheet accommodating device 200. In the sheet accommodating device 200 according to this exemplary embodiment, the plurality of accommodation units 201 to 203 are stacked in the vertical direction. Each of the accommodation units 201 to 203 has substantially the same configuration, and the following description will be given of the configuration of the accommodation unit 201.

The accommodation unit 201 includes a conveying roller 211 for conveying a sheet S, a stacking tray 221 in which sheets S are stacked on one another and are temporarily accommodated, and a sheet presence sensor 231 for detecting the presence or absence of a sheet S on the stacking tray 221. The accommodation unit 201 further includes a sheet moving unit 241 that presses the trailing end of an accommodated sheet S (the end thereof upstream of the conveyance direction of the sheet S) so that part of the accommodated sheet S can be exposed outside the image forming apparatus 100. The sheet moving unit 241 moves the sheet S to a position that allows the user to obtain the sheet S, that is, until the leading end of the sheet S (the end thereof downstream of the conveyance direction of the sheet S) has passed through an opening 250. Accordingly, the sheet S can be exposed outside the image forming apparatus 100 by a predetermined length. In this exemplary embodiment, the predetermined length by which the sheet S is exposed outside the image forming apparatus 100 is set to 30 mm, for illustrative but not limitative purposes. The predetermined length may be set to a value that allows the user to seize the exposed sheet S and that does not cause the sheet S to largely warp.

In addition, the length of the stacking tray 221 is set so that when a sheet S having a maximum size that permits the accommodation unit 201 to accommodate the sheet S is placed on the stacking tray 221, the leading end of the sheet S will not be exposed from the opening 250. When the sheet presence sensor 231 tilts to a position indicated by a broken line due to the placement of a sheet S on the stacking tray 221, the sheet presence sensor 231 is turned on. When the sheet presence sensor 231 returns to a position indicated by a solid line due to the movement of the sheet S by using the sheet moving unit 241, the sheet presence sensor 231 is turned off. Further, the leading end of the moving sheet S causes an opening sensor 236 disposed near the opening 250 to tilt to a position indicated by a broken line, resulting in the opening sensor 236 being turned on. When the sheet S exposed outside the image forming apparatus 100 is removed and the opening sensor 236 returns to a position indicated by a solid line, the opening sensor 236 is turned off. The sheet moving unit 241 is configured to be movable such that, when sheets S are sequentially conveyed to the accommodation unit 201, the sheet moving unit 241 is positioned at a stacking position indicated by a solid line, whereas, when exposing an accommodated sheet S, the sheet moving unit 241 moves toward the opening 250 in the conveyance direction of the sheet S to an exposure position indicated by a broken line. The location of the exposure position, that is, the distance by which the sheet moving unit 241 is movable, is determined in accordance with the length by which the sheet S is exposed and the size of the sheet S in the conveyance direction of the sheet S.

Figure 3:
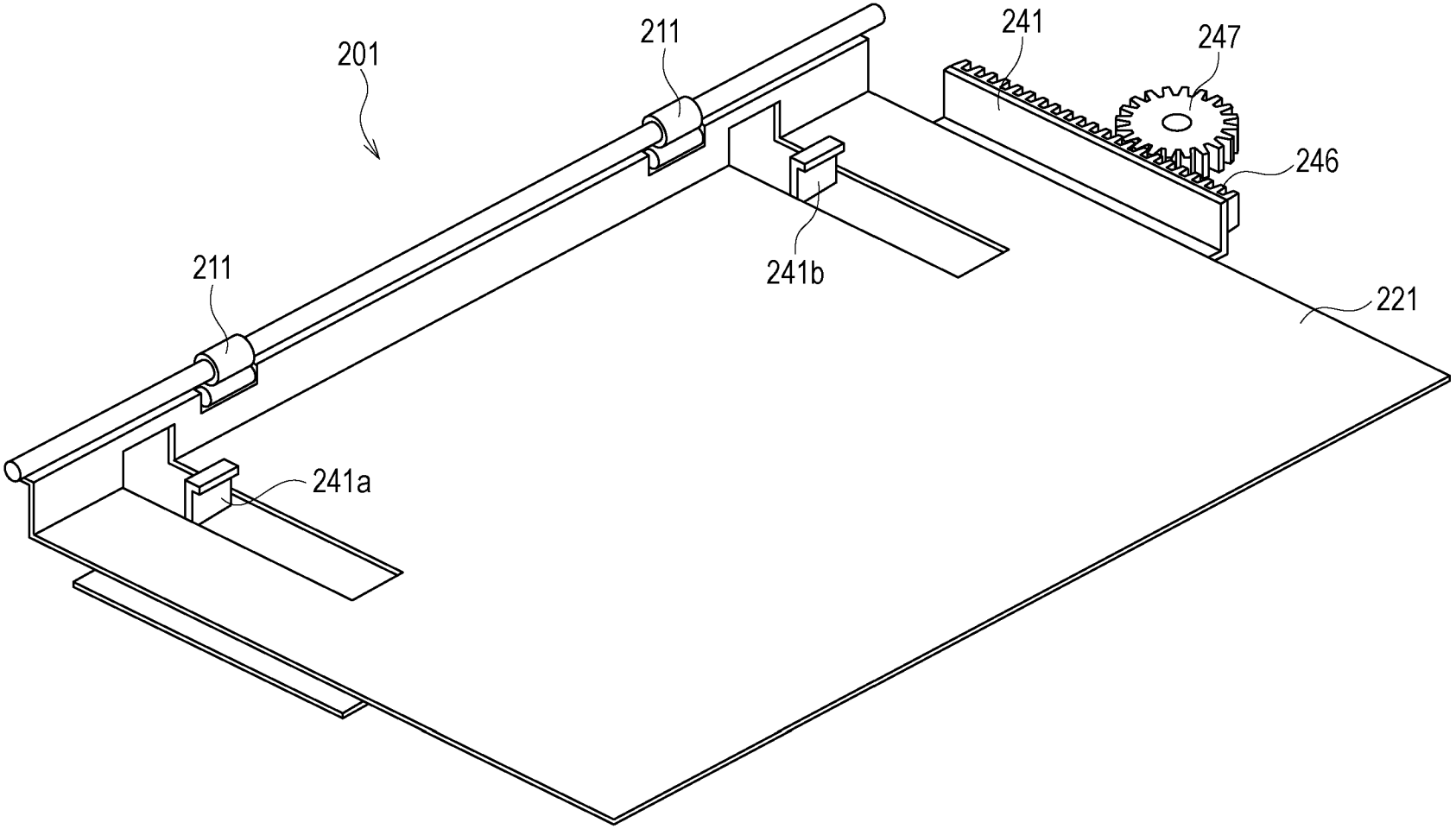
FIG. 3 is a perspective view of an accommodation unit according to the exemplary embodiments of the present invention.

FIG. 3 is a perspective view of the accommodation unit 201. In FIG. 3, the sheet moving unit 241 is located at a position between the stacking position and the exposure position. The sheet moving unit 241 includes two sheet trailing end pressing units 241*a* and 241*b* in the width direction of the sheet S. The sheet moving unit 241 further includes a rack 246 integrally formed therewith. The rack 246 meshes with a pinion 247, and the pinion 247 is connected to an actuator serving as a driving unit (not illustrated in FIG. 3). Driving the actuator forward or in reverse allows the sheet moving unit 241 to reciprocate between the stacking position and the exposure position.

Block diagram of control unit and functional units

Figure 4:
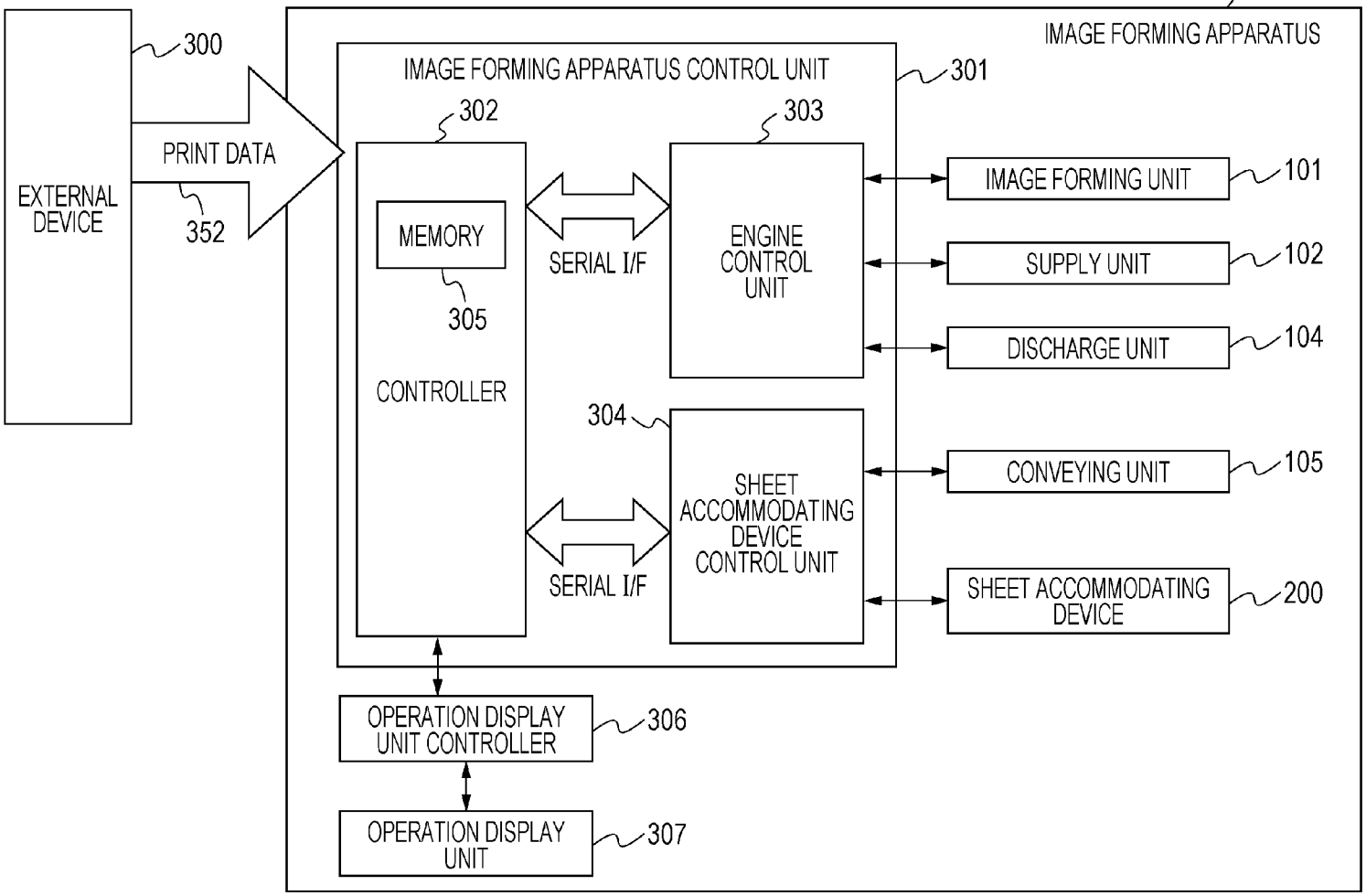
FIG. 4 is a block diagram illustrating a control unit and functional units of the image forming apparatus according to the exemplary embodiments of the present invention.

FIG. 4 is a block diagram illustrating a control unit and functional units according to this exemplary embodiment. The image forming apparatus 100 includes an image forming apparatus control unit 301 as a control unit. The image forming apparatus control unit 301 includes a controller 302, an engine control unit 303, and a sheet accommodating device control unit 304.

The controller 302 communicates with an external device 300 such as a host computer to receive print data 352, and stores the received print data 352 in a memory 305 (such as a random access memory (RAM)). The controller 302 analyzes the print data 352 stored in the memory 305 to create print conditions. The print conditions are information regarding the printing operation, such as the number of sheets S to be supplied, the destination to which sheets S having images formed thereon are to be discharged (i.e., the discharge tray 124 or the sheet accommodating device 200), and the density of images to be printed. The controller 302 provides the print conditions created regarding the print data 352 to the engine control unit 303 through a serial interface (I/F). The engine control unit 303 controls each mechanism in accordance with the print conditions received from the controller 302. Specifically, the engine control unit 303 controls the image forming unit 101 to form an image on a sheet S, and controls the supply unit 102 and the discharge unit 104 to supply and discharge the sheet S.

The controller 302 further analyzes the print data 352 stored in the memory 305 to create discharge conditions and accommodation conditions of the accommodation units 201 to 203. Then, the controller 302 provides the accommodation conditions and discharge conditions created regarding the print data 352 to the sheet accommodating device control unit 304 through a serial I/F. The accommodation conditions are information regarding the accommodation of sheets, such as the destination that is to accommodate sheets S having images formed thereon, and the number of sheets S to be accommodated. The discharge conditions are information regarding the discharge operation, such as the distance by which the sheet moving units 241 to 243 move to expose a sheet S from the opening 250. The sheet accommodating device control unit 304 controls each mechanism in accordance with the accommodation conditions and discharge conditions received from the controller 302. Specifically, the sheet accommodating device control unit 304 controls the conveying unit 105 to convey a sheet having an image formed thereon to one of the accommodation units 201 to 203, and controls the sheet accommodating device 200, which has the sheet moving units 241 to 243, to move the sheet accommodated in the one of the accommodation units 201 to 203 to the opening 250. An operation display unit controller 306 performs control to notify the controller 302 that a user has performed various settings or has given discharge instructions by using an operation display unit 307. A menu screen (initial screen) that represents the state and functions of the image forming apparatus 100 is displayed on a screen of the operation display unit 307. The operation display unit 307 serves as a touch panel. Pressing a button displayed on the operation display unit 307 allows a user to provide the image forming apparatus 100 or the sheet accommodating device 200 with various kinds of instructions. That is, the operation display unit 307 is an operation unit configured to accept an operation of a user, and is also a display unit configured to display information.

Details of Sheet Accommodating Device Control Unit

Figure 5:
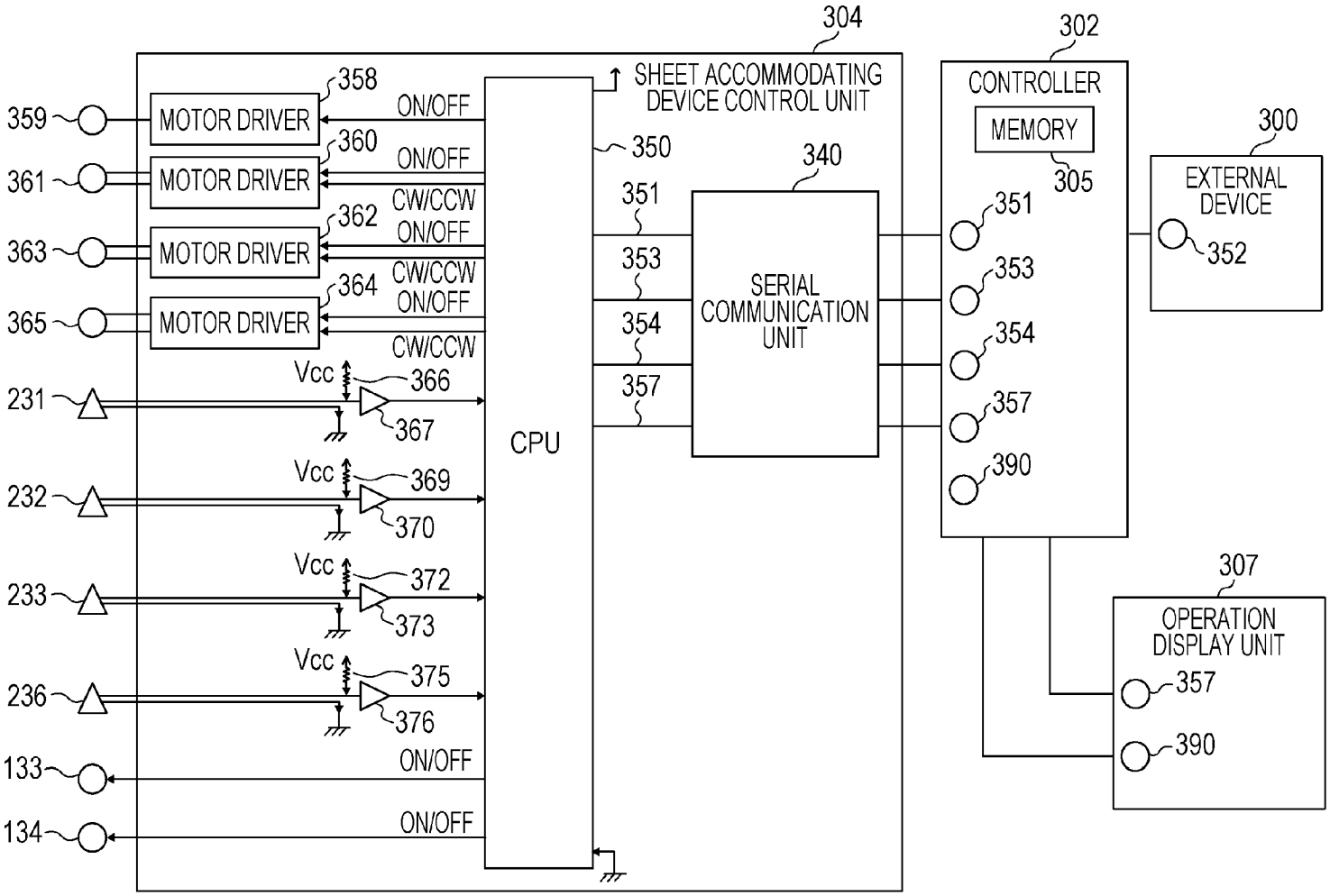
FIG. 5 is a detail view of a sheet accommodating device control unit according to the exemplary embodiments of the present invention.

FIG. 5 is a detail view of the sheet accommodating device control unit 304 according to this exemplary embodiment. The sheet accommodating device control unit 304 includes a central processing unit (CPU) 350, which communicates with the controller 302 via a serial communication unit 340. The serial communication unit 340 connects the CPU 350 to the controller 302 using a plurality of signal lines.

Control for accommodation of a sheet S in the sheet accommodating device 200 will be described. When the controller 302 is notified of the print data 352 via the external device 300, the controller 302 temporarily stores the print data 352 in the memory 305. After that, the controller 302 analyzes the stored print data 352, and notifies the CPU 350 of an operation mode signal 351, an entry notice signal 353, and an accommodation destination signal 354 via the serial communication unit 340. The controller 302 further stores a job number of a job for each sheet, and user information on a user who has given instructions to print each sheet in the memory 305. The operation mode set by using the operation mode signal 351 is a mode to determine how sheets are sorted to a plurality of accommodation units. In this exemplary embodiment, a job-based sorting mode is set in advance by using the operation mode signal 351. The job-based sorting mode is a mode to sort sheets to accommodation units that are different for individual job numbers. The CPU 350 controls each actuator described below in accordance with a received signal, and conveys a printed sheet S to one of the accommodation units 201 to 203.

Next, control for exposure of a sheet S from the sheet accommodating device 200 will be described. In this exemplary embodiment, sheets having the same user information are collectively exposed from the opening 250. For this reason, the controller 302 combines sheets having the same user information into a group on the basis of the user information on the sheets stored in the memory 305. Then, the controller 302 notifies the operation display unit 307 of a display switching signal 390 to display the names of groups, that is, the names of users, on the screen of the operation display unit 307. A user selects their name from among the displayed names to obtain a sheet for which the user has instructed printing. When the user selects their name and instructs the image forming apparatus 100 to discharge a sheet, the controller 302 is notified of a discharge instruction signal 357. The controller 302 determines one of the accommodation units from which the sheet is to be discharged, and then notifies the CPU 350 of the discharge instruction signal 357 via the serial communication unit 340 to provide instructions to discharge the sheet from the accommodation unit. The CPU 350 controls each actuator described below to expose the sheet S in the designated accommodation unit from the opening 250 to outside the image forming apparatus 100.

Next, actuators connected to the CPU 350 will be described.

A motor driver 358 is connected to an output terminal of the CPU 350. The motor driver 358 drives a conveyance motor 359. As the conveyance motor 359 rotates, the conveying rollers 211, 212, and 213 rotates to convey sheets S to the accommodation units 201 to 203.

A motor driver 360 is connected to an output terminal of the CPU 350. The motor driver 360 drives a discharge motor 361. When the discharge motor 361 is rotated in a clockwise (CW) direction, the sheet moving unit 241 of the accommodation unit 201 moves toward the opening 250. When the discharge motor 361 is rotated in a counterclockwise (CCW) direction, the sheet moving unit 241 of the accommodation unit 201 moves in ad direction opposite to the direction toward the opening 250. Furthermore, motor drivers 362 and 364 are connected to output terminals of the CPU 350, and drive discharge motors 363 and 365, respectively. The motor 363 controls the sheet moving unit 242 of the accommodation unit 202, and the motor 365 controls the sheet moving unit 243 of the accommodation unit 203.

The sheet presence sensor 231 uses a pull-up resistor 366 to input information as to whether or not the accommodation unit 201 accommodates a sheet S to the CPU 350 through a buffer 367. Likewise, a sheet presence sensor 232 uses a pull-up resistor 369 to input information as to whether or not the accommodation unit 202 accommodates a sheet S to the CPU 350 through a buffer 370. A sheet presence sensor 233 uses a pull-up resistor 372 to input information as to whether or not the accommodation unit 203 accommodates a sheet S to the CPU 350 through a buffer 373.

The opening sensor 236 uses a pull-up resistor 375 to input information as to whether or not a sheet S has been exposed from the opening 250 to outside the image forming apparatus 100 to the CPU 350 through a buffer 376.

Figure 6A:
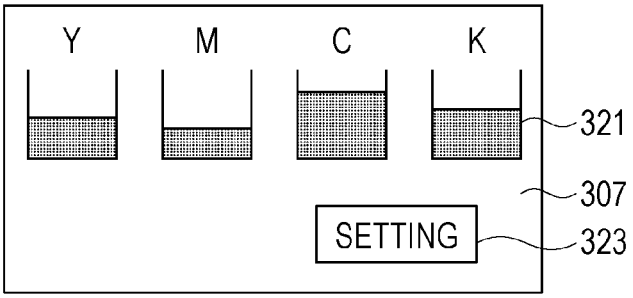
FIGS. 6A to 6E are diagrams illustrating screens of an operation display unit according to a first exemplary embodiment of the present invention.

An actuator (not illustrated) for switching the second switching member 133 is connected to an output terminal of the CPU 350. When the actuator is on, the second switching member 133 is switched so that a sheet S is conveyed to the conveyance guide 129. When the actuator is off, the second switching member 133 is switched so that a sheet S is conveyed to the conveyance guide 132. Likewise, an actuator (not illustrated) for switching the third switching member 134 is connected to an output terminal of the CPU 350. When the actuator is on, the third switching member 134 is switched so that a sheet S is conveyed to the conveyance guide 130. When the actuator is off, the third switching member 134 is switched so that a sheet S is conveyed to the conveyance guide 131. The CPU 350 switches each of the second switching member 133 and the third switching member 134 in accordance with the accommodation destination signal 354 received from the controller 302. Explanation of operation of sheet accommodating device and screen control of operation display unit Next, the operation of the sheet accommodating device 200 and the screen control of the operation display unit 307 will be described. FIGS. 6A to 6E are diagrams illustrating screens displayed on the operation display unit 307. FIG. 7 is a flowchart illustrating control of the switching of the screens on the operation display unit 307. The control process in the illustrated flowchart is executed by the controller 302 or the like described with reference to FIG. 4 in accordance with a program stored in the memory 305. When the sheet accommodating device 200 is not in use, the controller 302 causes the operation display unit 307 to display a menu screen (initial screen) illustrated in FIG. 6A that represents the state and functions of the image forming apparatus 100 (S400). Here, regarding the determination as to whether or not the sheet accommodating device 200 is in use, the following definitions are used: It is determined that the sheet accommodating device 200 is in use during a period from the time when image forming instructions are issued to the sheet accommodating device 200 to accommodate a sheet to the time when the sheets in all the accommodation units 201 to 203 have been removed by a user, and, during the other period, it is determined that the sheet accommodating device 200 is not in use. In this exemplary embodiment, as illustrated in FIG. 6A, remaining toner levels 321 and a SETTING button 323 are displayed on the menu screen. Pressing the SETTING button 323 allows a user to perform various settings of the image forming apparatus 100. Any other information such as the number of sheets remaining in the supply cassette 106 may be displayed on the menu screen.

When a certain user (for example, SUZUKI) gives image forming instructions from the external device 300 to the sheet accommodating device 200 to accommodate a sheet having an image formed thereon (S401), as described above, the image forming apparatus 100 conveys the sheet having an image formed thereon to the sheet accommodating device 200. In this case, the user does not need to select which of the three accommodation units 201 to 203 to convey the sheet to. Instead of this, the controller 302 detects an empty one of the accommodation units 201 to 203, and causes the sheet to be conveyed to the empty accommodation unit. The sheet accommodating device 200 becomes in use at the time when the user gives image forming instructions to the sheet accommodating device 200 to accommodate a sheet. Also, the controller 302 notifies the operation display unit 307 of a display switching signal 390 to switch the screen of the operation display unit 307 to a selection screen illustrated in FIG. 6B, 6C, or 6D (S402). In this exemplary embodiment, the selection screen includes a user selection button 325. The user selection button 325 is labeled with the name of the user who has given instructions to print the sheet accommodated in the sheet accommodating device 200.

Figure 6B:
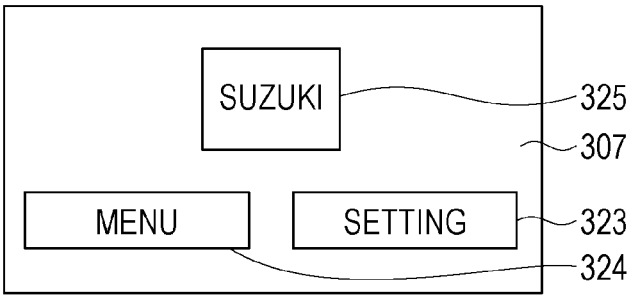
Figure 6C:
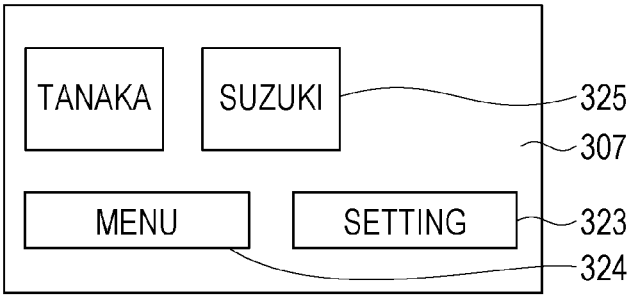
Figure 6D:
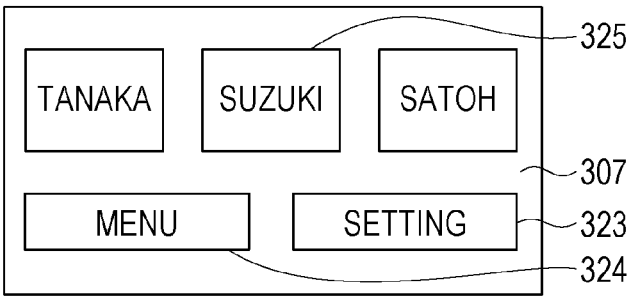
Figure 7:
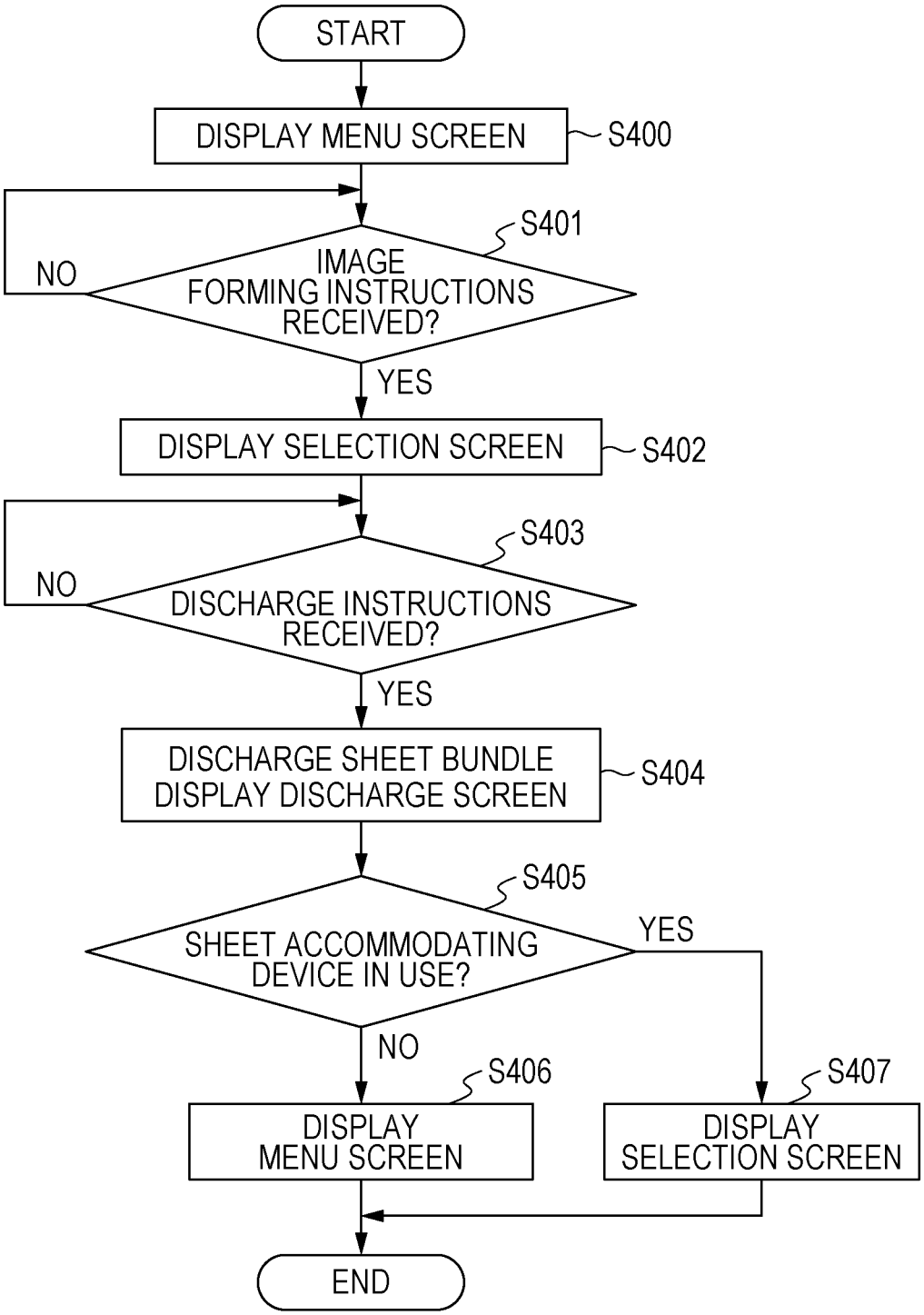
FIG. 7 is a flowchart of the operation according to the first exemplary embodiment of the present invention.

FIG. 6B illustrates a selection screen when the sheet accommodating device 200 accommodates a sheet of one user (SUZUKI). FIG. 6C illustrates a selection screen when the sheet accommodating device 200 accommodates sheets of two users (SUZUKI and TANAKA). FIG. 6D illustrates a selection screen when the sheet accommodating device 200 accommodates sheets of three users (SUZUKI, TANAKA, and SATOU). In this way, when a sheet of a new user is accommodated in the sheet accommodating device 200, a new user selection button 325 is displayed so that the new user selection button 325 and the existing user selection button or buttons 325 are arranged side by side horizontally. Since the sheet accommodating device 200 according to this exemplary embodiment includes three accommodation units, namely, the accommodation units 201 to 203, sheets of up to three users can be accommodated at the same time. The selection screen further includes a MENU button 324 and a SETTING button 323 in addition to the user selection button 325. The MENU button 324 is used to return to the menu screen. The SETTING button 323 is used to perform various settings of the image forming apparatus 100 and the sheet accommodating device 200.

Figure 6E:
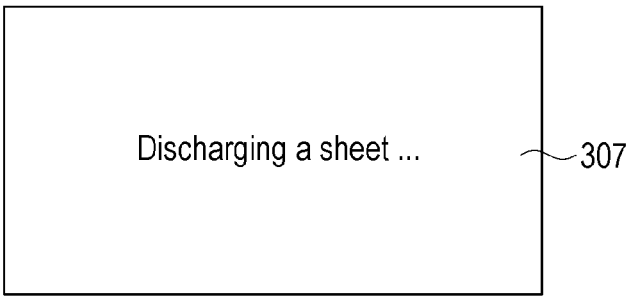

When a user (for example, SUZUKI) wishes to remove their sheet from the sheet accommodating device 200, the user selects the user selection button 325 (SUZUKI) displayed on the operation display unit 307 serving as a touch panel to give discharge instructions to the controller 302 (S403). Upon receipt of the discharge instructions, the controller 302 notifies the operation display unit 307 of a display switching signal 390 at the same time as the discharge of the sheet. In accordance with the display switching signal 390, as illustrated in FIG. 6E, the screen of the operation display unit 307 is switched to a discharge screen indicating that the sheet is currently being discharged (S404).

When the discharge of a sheet is completed, a portion of the sheet is exposed from the opening 250 to outside the image forming apparatus 100, and the opening sensor 236 is turned on. When the user removes the exposed sheet, the opening sensor 236 is turned off, and the controller 302 detects the removal of the sheet from the opening 250. After that, the corresponding one of the sheet moving units 241, 242, and 243 moves from the exposure position to the stacking position. Also, the controller 302 determines whether or not the sheet accommodating device 200 is in use (S405), and switches the display of the operation display unit 307 in accordance with the display switching signal 390. If the sheet accommodating device 200 accommodates no sheet, the screen of the operation display unit 307 is switched to the menu screen (S406). If the sheet accommodating device 200 still accommodates a sheet, the selection screen is still displayed as the screen of the operation display unit 307 (S407).

Figures 8A, 8B:
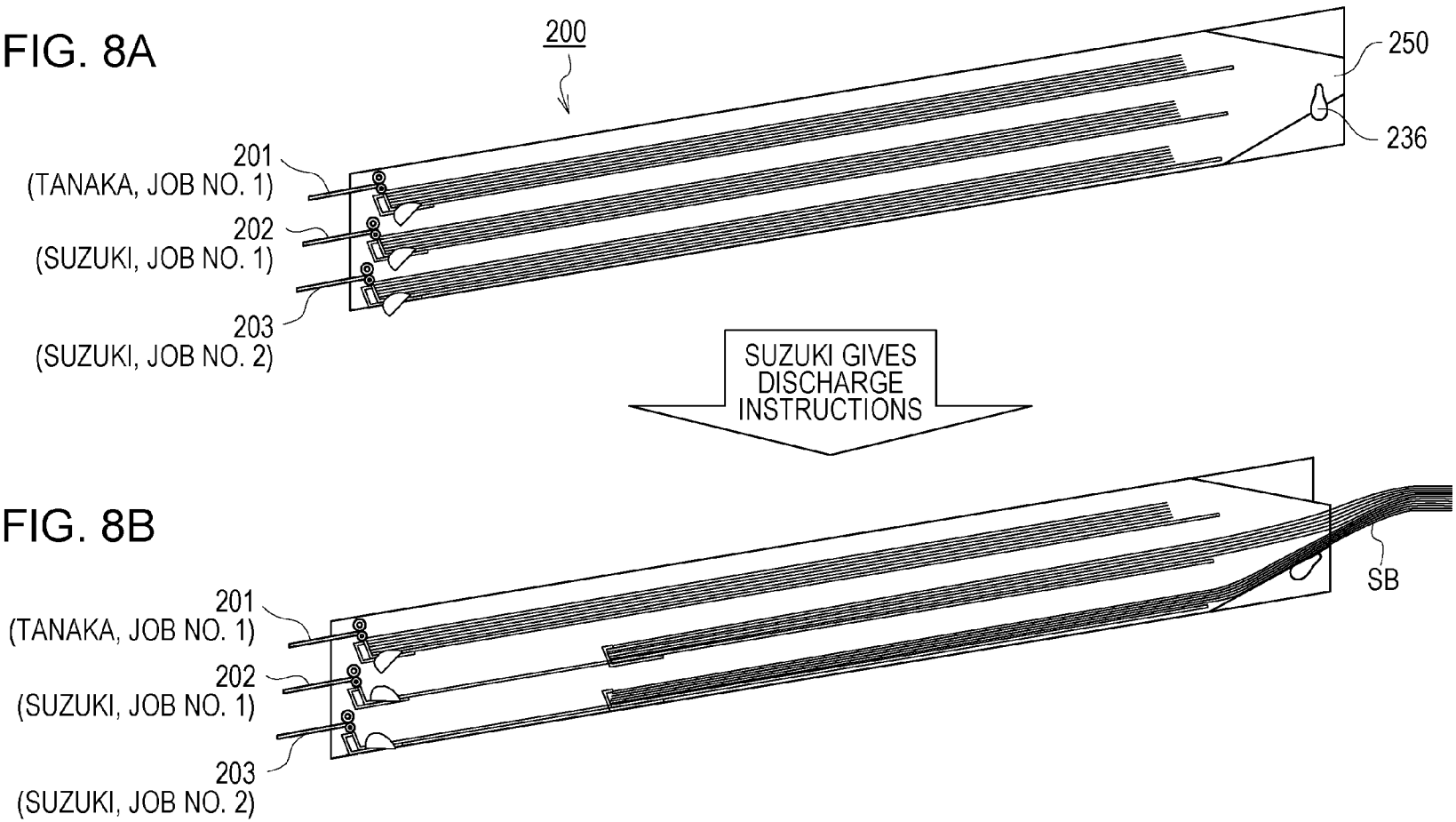
FIGS. 8A and 8B are diagrams illustrating how the sheet accommodating device operates when a sheet is exposed according to the exemplary embodiments of the present invention.

FIGS. 8A and 8B are diagrams illustrating an example of the operation of the sheet accommodating device 200. In FIG. 8A, the accommodation unit 201 accommodates a sheet S for which TANAKA has instructed printing, and the accommodation units 202 and 203 accommodate sheets S for which SUZUKI has instructed printing. The accommodation unit 202 accommodates the sheet S having job number 1 among the sheets for which SUZUKI has instructed printing, and the accommodation unit 203 accommodates the sheet S having job number 2. At this time, the screen of the operation display unit 307 has been switched from the menu screen illustrated in FIG. 6A to the selection screen illustrated in FIG. 6C. FIG. 8B illustrates a result obtained when SUZUKI presses the user selection button 325 ("SUZUKI") displayed on the operation display unit 307 and gives discharge instructions to the controller 302. In FIG. 8B, the sheet moving units 242 and 243 of the accommodation units 202 and 203 move toward the opening 250, and expose a sheet bundle SB from the opening 250.

Figure 9:
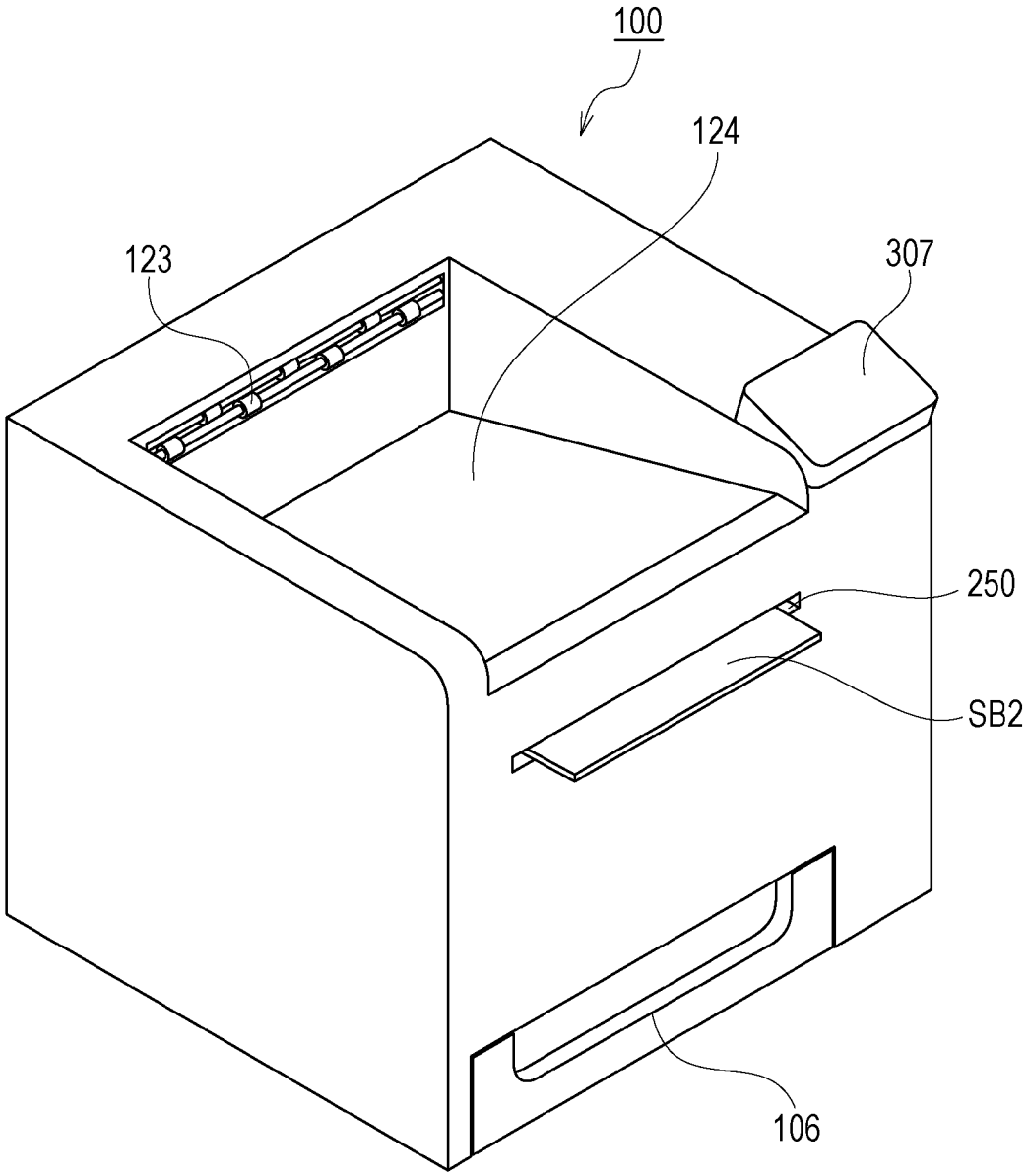
FIG. 9 is a perspective view of the image forming apparatus according to the exemplary embodiments of the present invention when a sheet is exposed.

FIG. 9 is a perspective view of the image forming apparatus 100 in the above case. The leading end SB2 of the sheet bundle SB exposed from the accommodation units 202 and 203 are exposed from the opening 250. By seizing and pulling the leading end SB2 exposed outside the image forming apparatus 100, the user is able to remove the sheet bundle SB. As illustrated in FIG. 9, the operation display unit 307 is disposed above the image forming apparatus 100.

If a user gives instructions to accommodate a number of sheets S larger than the maximum number of sheets that one accommodation unit is allowed to accommodate, the sheets S are sorted to different accommodation units even when the sheets S have the same job number. For example, in FIG. 8A, the accommodation units 202 and 203 accommodate the sheets S of SUZUKI having different job numbers. In this case, if the number of sheets having job number 1 is larger than the upper limit number of sheets of the accommodation unit 202, some of the sheets S having job number 1 are also sorted to the accommodation unit 203. Note that, in this case, it is assumed that the accommodation unit 203 does not accommodate any other sheet S. The term "any other sheet" is used to include sheets having different job numbers, and sheets of different users.

In the image forming apparatus 100 according to this exemplary embodiment, the sheet accommodating device 200 is surrounded by a member, except for a sheet conveying port (not illustrated) through which sheets S are conveyed and the opening 250 from which accommodated sheets S are exposed. The member that surrounds the sheet accommodating device 200 is made of an opaque material. This prevents the user from checking from outside whether the accommodation units 201 to 203 accommodate a sheet S. However, displaying screens that vary from one situation to another on the operation display unit 307 allows the user to instantly find that each of the accommodation units 201 to 203 accommodates a sheet S.

In addition, the user is able to remove only their sheet by giving instructions to the image forming apparatus 100 to discharge the sheet. This would save the user from having to find their sheet in the discharge tray 124 where both their sheet and other people's sheets are present.

The configuration described above allows a screen to be displayed on the operation display unit 307 in accordance with the situation. Accordingly, usability may be improved.

Second Exemplary Embodiment

In the first exemplary embodiment, the description has been given of a control method to display the menu screen on the operation display unit 307 when the sheet accommodating device 200 is not in use and to switch the screen of the operation display unit 307 to the selection screen when the sheet accommodating device 200 becomes in use. In a second exemplary embodiment, a description will be given of a control operation to perform user authentication after a user selects the user selection button 325 on the selection screen. Main portions are similar to those in the first exemplary embodiment, and only differences from the first exemplary embodiment will now be discussed.

Figure 10A:
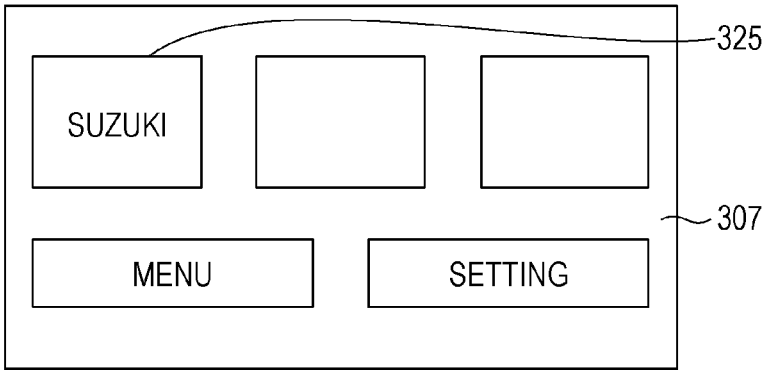
FIGS. 10A to 10D are diagrams illustrating screens of an operation display unit according to a second exemplary embodiment of the present invention.
Figure 10B:
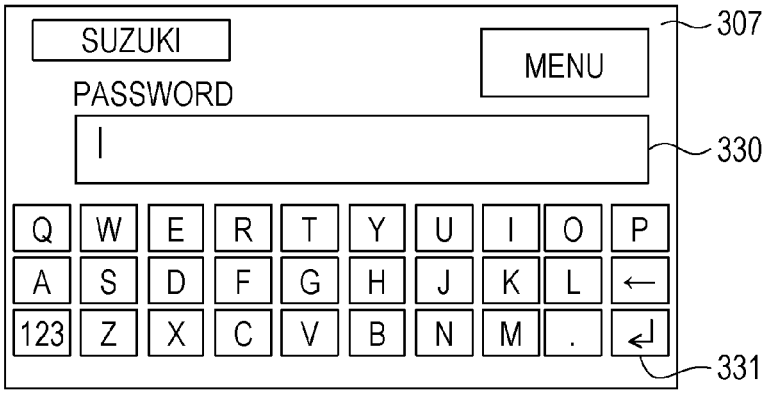
Figure 10C:
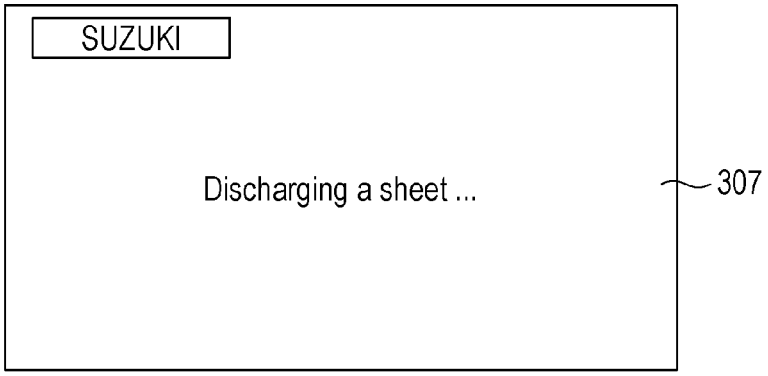
Figure 10D:
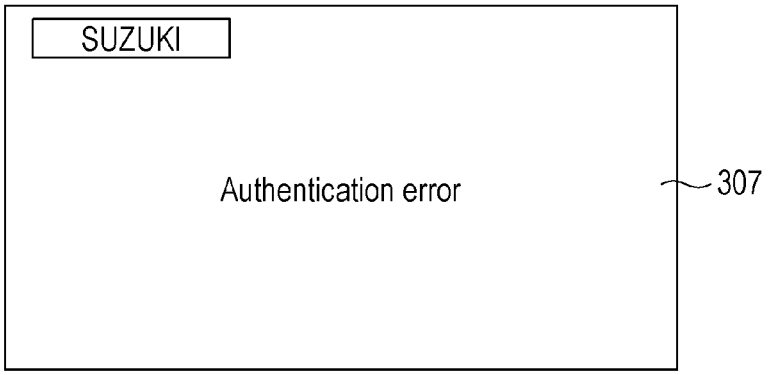
Figure 11:
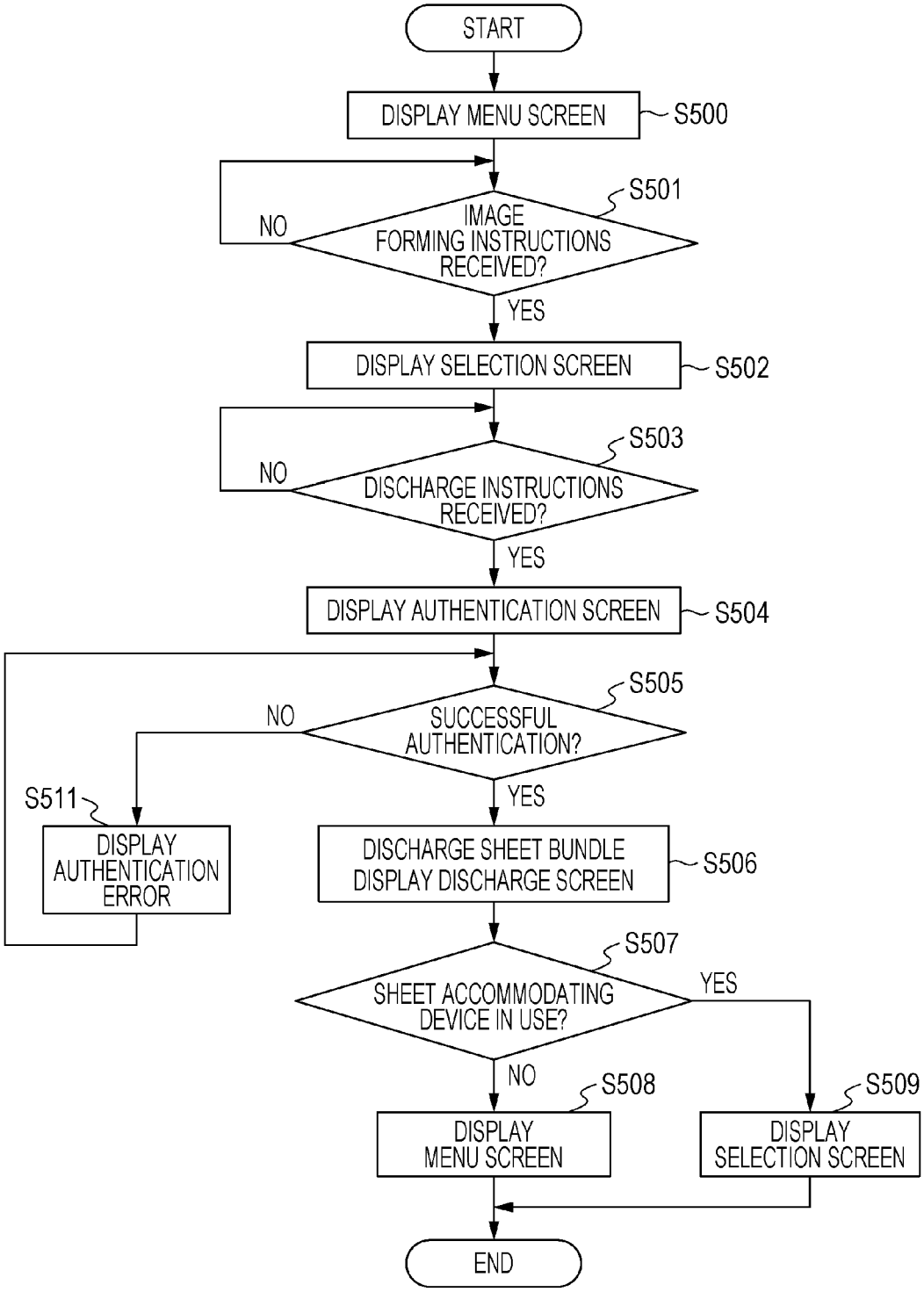
FIG. 11 is a flowchart of the operation according to the second exemplary embodiment of the present invention.

FIGS. 10A to 10D are diagrams illustrating screens displayed on the operation display unit 307 according to this exemplary embodiment. FIG. 11 is a flowchart illustrating control of the switching of the screens on the operation display unit 307. The control process in the illustrated flowchart is executed by the controller 302 or the like described with reference to FIG. 4 in accordance with a program stored in the memory 305.

When the sheet accommodating device 200 is not in use, the controller 302 causes the operation display unit 307 to display the menu screen illustrated in FIG. 6A that represents the state and functions of the image forming apparatus 100 (S500). When a certain user (for example, SUZUKI) gives image forming instructions from the external device 300 to the sheet accommodating device 200 to accommodate a sheet having an image formed thereon (S501), as described above, the image forming apparatus 100 conveys the sheet having an image formed thereon to the sheet accommodating device 200. In this case, the user sets authentication information such as a password for the corresponding job, and notifies the controller 302 of the authentication information. The sheet accommodating device 200 becomes in use at the time when the user gives image forming instructions to the sheet accommodating device 200 to accommodate a sheet. Also, the controller 302 notifies the operation display unit 307 of a display switching signal 390, thereby switching the screen of the operation display unit 307 to the selection screen illustrated in FIG. 10A (S502). FIG. 10A illustrates a selection screen when the sheet accommodating device 200 accommodates a sheet of one user (SUZUKI).

When a user (for example, SUZUKI) wishes to remove their sheet from the sheet accommodating device 200, the user selects the user selection button 325 ("SUZUKI") displayed on the operation display unit 307 serving as a touch panel to give discharge instructions to the controller 302 (S503). Upon receipt of discharge instructions, the controller 302 notifies the operation display unit 307 of a display switching signal 390 at the same time as the discharge of the sheet. In accordance with the display switching signal 390, the screen of the operation display unit 307 is switched to an authentication screen illustrated in FIG. 10B for authenticating whether the user is authorized to expose the sheet (S504). The user is able to enter a password, which is authentication information, in a field 330 by using a keyboard 331 on the screen. The controller 302 determines whether or not the authentication information that has been previously received from the external device 300 matches the authentication information entered by the user on the operation display unit 307 (S505). If both pieces of authentication information do not match, the screen of the operation display unit 307 is switched to an authentication error screen illustrated in FIG. 10D (S511), and prompts the user to enter authentication information again. If both pieces of authentication information match, the screen of the operation display unit 307 is switched to a discharge screen illustrated in FIG. 10C indicating that the discharge of the sheet is in progress at the same time as the discharge of the sheet (S506).

When the user removes the exposed sheet, the controller 302 determines whether the sheet accommodating device 200 is in use (S507), and switches the display of the operation display unit 307 in accordance with the display switching signal 390. If the sheet accommodating device 200 accommodates no sheet, the screen of the operation display unit 307 is switched to the menu screen (S508). If the sheet accommodating device 200 still accommodates a sheet, the screen of the operation display unit 307 is switched to the selection screen (S509).

In the image forming apparatus 100 according to this exemplary embodiment, the sheet accommodating device 200 is surrounded by a member, except for a sheet conveying port (not illustrated) through which sheets S are conveyed and the opening 250 from which sheets S accommodated in the sheet accommodating device 200 are exposed. The member that surrounds the sheet accommodating device 200 is made of an opaque material. This prevents the user from observing information printed on a sheet S in each of the accommodation units 201 to 203 while the accommodation unit accommodates the sheet S. In the image forming apparatus 100 according to this exemplary embodiment, furthermore, a sheet is discharged after user authentication takes places on the authentication screen displayed after the selection screen. This allows the user to hide information printed on their sheet S from other users, increasing the confidentiality of the information.

In terms of an increase in information confidentiality, there is available an image forming apparatus configured to start formation of an image after user authentication is performed. In contrast to such an image forming apparatus, the image forming apparatus 100 according to this exemplary embodiment may only be required to expose a sheet S having an image formed thereon from each of the accommodation units 201 to 203. Accordingly, a user may be able to quickly remove a sheet S, without waiting for an image to be formed, after performing user authentication.

In addition, the user may be able to remove only their sheet by giving instructions to the image forming apparatus 100 to discharge the sheet. This would save the user from having to find their sheet in the discharge tray 124 where both their sheet and other people's sheets are present.

In addition to achieving the advantages of the first exemplary embodiment, the configuration described above may improve the confidentiality of information on a sheet accommodated in the sheet accommodating device 200.

When the user gives image forming instructions from the external device 300 to the sheet accommodating device 200 to accommodate a sheet, unless authentication information is set for the job, the subsequent process may be the same as that in the first exemplary embodiment. In addition, the screen of the operation display unit 307 may not necessarily be switched to the authentication screen.

Third Exemplary Embodiment

In the first exemplary embodiment, the description has been given of a control method in which the menu screen is displayed on the operation display unit 307 when the sheet accommodating device 200 is not in use and in which the screen of the operation display unit 307 is switched to the selection screen when the sheet accommodating device 200 becomes in use. In the second exemplary embodiment, the description has been given of a control method in which user authentication is performed after the user has selected the user selection button 325 on the selection screen. In a third exemplary embodiment, control is performed so that when the sheet accommodating device 200 becomes in use, the screen of the operation display unit 307 is switched to the authentication screen. Main portions are similar to those in the first exemplary embodiment, and only differences from the first exemplary embodiment will now be discussed.

In the first exemplary embodiment and the second exemplary embodiment, sheets having the same user information are combined into a group, and the sheets belonging to the group are exposed from the opening 250. In this exemplary embodiment, sheets of users who belong to the same department and belong to the same team are combined into a group on the basis of user information on the users, and the sheets belonging to the group can be exposed from the opening 250.

FIGS. 12A to 12D are diagrams illustrating screens displayed on the operation display unit 307 in this exemplary embodiment. FIG. 13 is a flowchart illustrating control of the switching of the screens on the operation display unit 307. The control process in the illustrated flowchart is executed by the controller 302 or the like described with reference to FIG. 4 in accordance with a program stored in the memory 305.

When the sheet accommodating device 200 is not in use, the controller 302 causes the operation display unit 307 to display the menu screen illustrated in FIG. 6A that represents the state and functions of the image forming apparatus 100 (S600). When a certain user (for example, SUZUKI) gives image forming instructions from the external device 300 to the sheet accommodating device 200 to accommodate a sheet having an image formed thereon (S601), as described above, the image forming apparatus 100 conveys the sheet having an image formed thereon to the sheet accommodating device 200. In this case, the user sets authentication information such as a password for the corresponding job, and notifies the controller 302 of the authentication information. The sheet accommodating device 200 becomes in use at the time when the user gives image forming instructions to the sheet accommodating device 200 to accommodate a sheet. Also, the controller 302 notifies the operation display unit 307 of a display switching signal 390, thereby switching the screen of the operation display unit 307 to an authentication screen illustrated in FIG. 12A (S602).

When the user (for example, SUZUKI) wishes to remove their sheet from the sheet accommodating device 200, the user inputs their name ("SUZUKI") and authentication information on the authentication screen displayed on the operation display unit 307 serving as a touch panel. The user is able to enter their name in a field 332 and a password, which is authentication information, in a field 333 on the above screen by using a keyboard 331. The controller 302 determines whether or not the name and authentication information that have been previously received from the external device 300 match the name and authentication information entered by the user on the operation display unit 307 (S603). If both pieces of information do not match, the screen of the operation display unit 307 is switched to an authentication error screen illustrated in FIG. 12D (S611), and prompts the user to enter their name and authentication information again. If both pieces of information match, the controller 302 detects a group for which the user is allowed to discharge sheets (hereinafter referred to as a "group accessible to the user") (S604), and a selection screen illustrated in FIG. 12B on which a list of groups accessible to the user is displayed (S605). In the example illustrated in FIG. 12B, three groups ("SUZUKI", "SALES DIVISION", and "TEAM A") are displayed as groups accessible to the user (SUZUKI). That is, the user (SUZUKI) is able to remove their sheet and also remove sheets of members in the department (SALES DIVISION) and team (TEAM A) to which the user belongs.

When removing a sheet from the sheet accommodating device 200, the user selects a group selection button 334 associated with the desired group among group selection buttons 334 displayed on the operation display unit 307 serving as a touch panel to give discharge instructions to the controller 302 (S606). In this exemplary embodiment, three group selection buttons 334 ("SUZUKI", "SALES DIVISION", and "TEAM A") are displayed. At the time of receiving the discharge instructions, the controller 302 notifies the operation display unit 307 of a display switching signal 390 at the same time as the discharge of the sheet. In accordance with the display switching signal 390, as illustrated in FIG. 12C, the screen of the operation display unit 307 is switched to a discharge screen indicating that the sheet is currently being discharged (S607).

When the user removes the exposed sheet, the controller 302 determines whether the sheet accommodating device 200 is in use (S608), and switches the display of the operation display unit 307 in accordance with the display switching signal 390. If the sheet accommodating device 200 accommodates no sheet, the screen of the operation display unit 307 is switched to the menu screen (S609). If the sheet accommodating device 200 still accommodates a sheet, the screen of the operation display unit 307 is switched to the authentication screen (S610).

In the image forming apparatus 100 according to this exemplary embodiment, the sheet accommodating device 200 is surrounded by a member, except for a sheet conveying port (not illustrated) through which sheets S are conveyed and the opening 250 from which sheets S accommodated in the sheet accommodating device 200 are exposed. The member that surrounds the sheet accommodating device 200 is made of an opaque material. This prevents the user from observing information printed on a sheet S in each of the accommodation units 201 to 203 while the accommodation unit accommodates sheet S. In the image forming apparatus 100 according to this exemplary embodiment, furthermore, a sheet is discharged after user authentication takes places on the authentication screen. This allows the user to hide information printed on their sheet S from members who belong to other groups, increasing the confidentiality of the information.

In terms of an increase in information confidentiality, there is available an image forming apparatus configured to start formation of an image after user authentication is performed. In contrast to such an image forming apparatus, the image forming apparatus 100 according to this exemplary embodiment may only be required to expose a sheet S having an image formed thereon from each of the accommodation units 201 to 203. Accordingly, a user may be able to quickly remove a sheet S, without waiting for an image to be formed, after performing user authentication.

In addition, the user may be able to remove only their sheet or a sheet of a member of a group to which the user belongs by giving instructions to the image forming apparatus 100 to discharge the sheet. This would save the user from having to find the desired sheet in the discharge tray 124 where a variety of sheets are present.

In addition to the advantages of the first exemplary embodiment, the configuration described above may improve the confidentiality of information on a sheet accommodated in the sheet accommodating device 200.

Figure 12A:
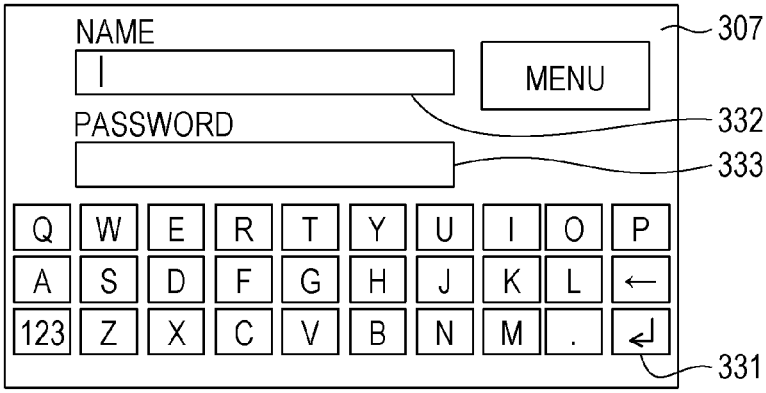
FIGS. 12A to 12D are diagrams illustrating screens of an operation display unit according to a third exemplary embodiment of the present invention.
Figure 12B:
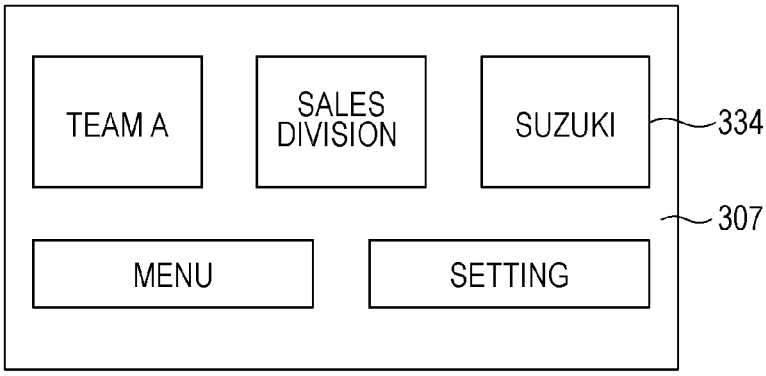
Figure 12C:
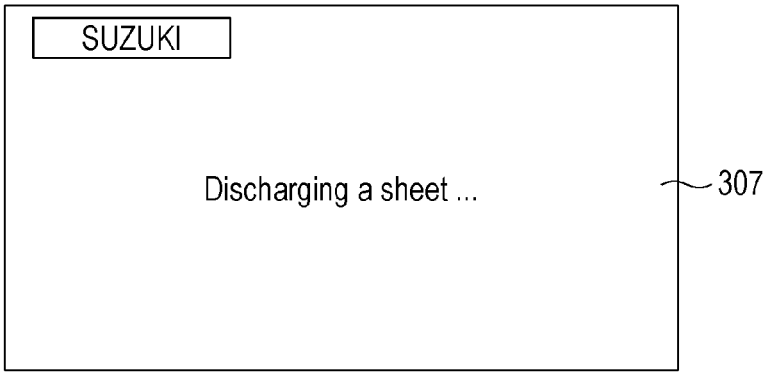
Figure 12D:
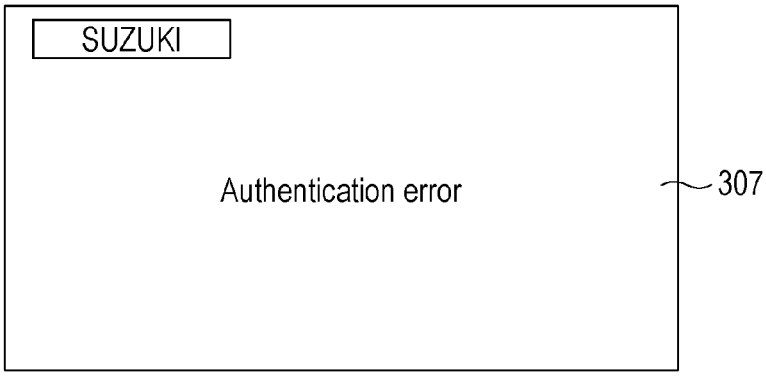
Figure 13:
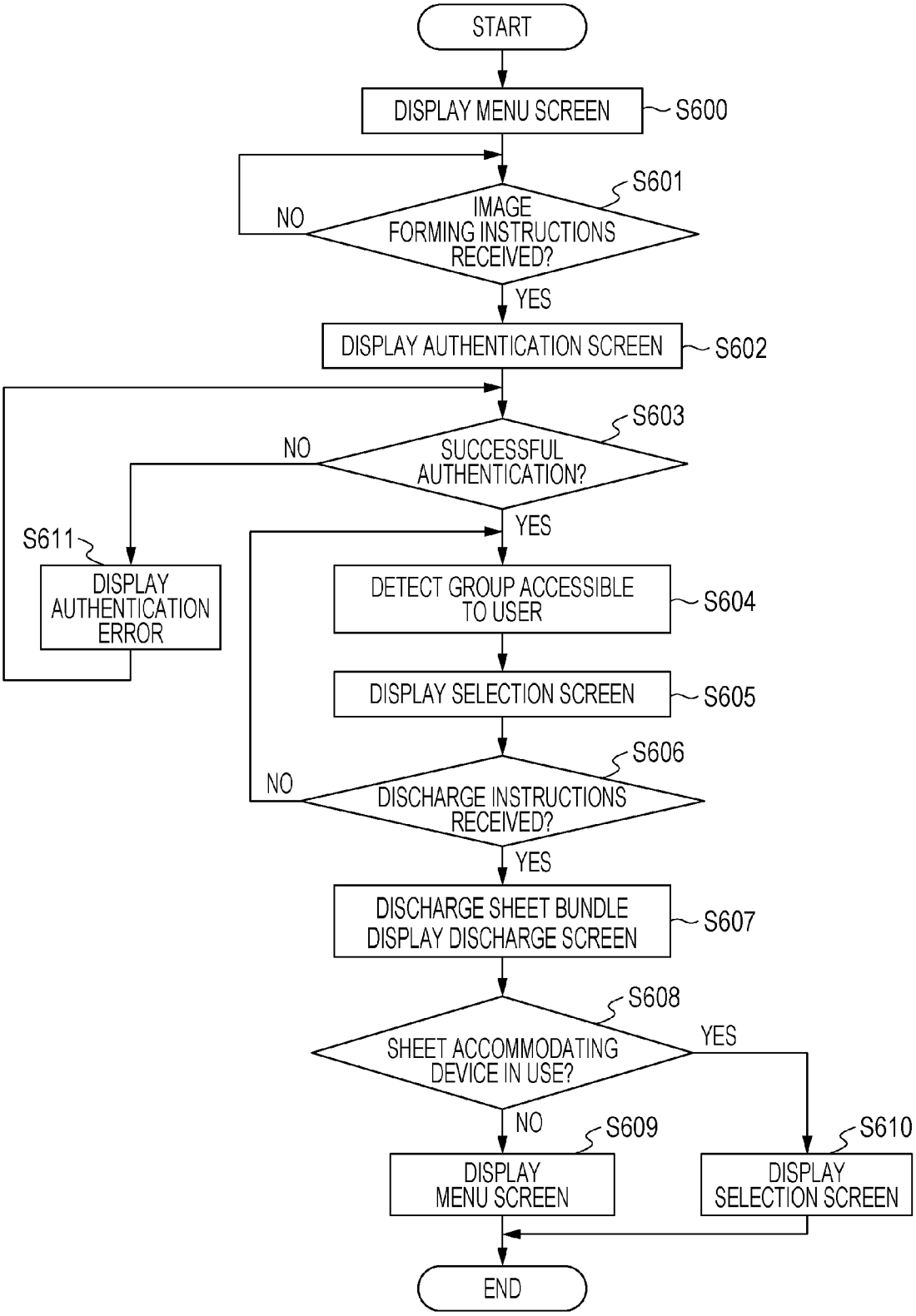
FIG. 13 is a flowchart of the operation according to the third exemplary embodiment of the present invention.

The authentication screen illustrated in FIG. 12A has a configuration in which authentication information and a user name are entered. The authentication screen may have a configuration in which only authentication information is entered.

Figure 14A:
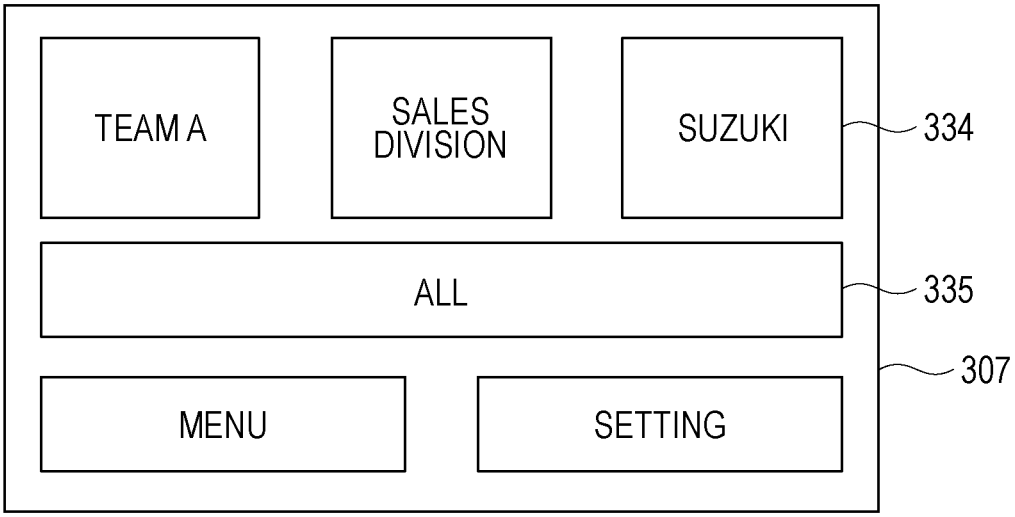
FIGS. 14A and 14B are diagrams illustrating screens of an operation display unit according to a modification of the present invention.
Figure 14B:
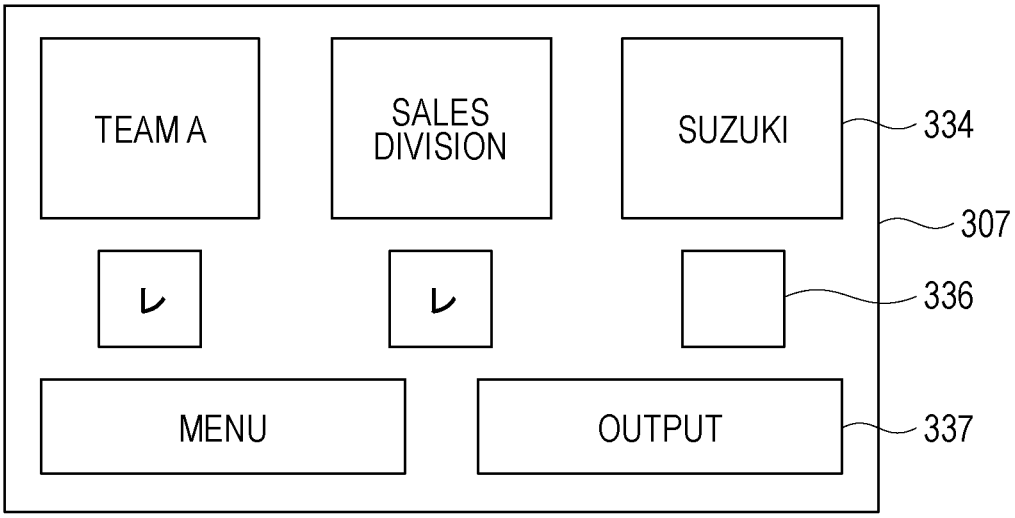

In this exemplary embodiment, furthermore, the description has been given of a configuration in which one of a plurality of groups displayed on the selection screen is selected and discharge instructions are given, for illustrative but not limitative purposes. For example, the following configuration may be used: As illustrated in FIG. 14A, an ALL button 335 for discharging the sheets for all the groups accessible to a particular user is displayed on the selection screen of the operation display unit 307. As illustrated in FIG. 14B, selection boxes 336 are displayed. After one of the selection boxes 336, which is associated with a desired group, is selected, an OUTPUT button 337 is pressed to discharge the sheets for the selected group.

In this exemplary embodiment, furthermore, if only one of the groups for which the sheet accommodating device 200 accommodates sheets is accessible to a user, the sheets for the group accessible to the user may be discharged immediately after the user has been authenticated, without the selection screen being displayed in S605 in FIG. 13.

In this exemplary embodiment, furthermore, even if a plurality of groups accessible to a user are included in the groups for which the sheet accommodating device 200 accommodate sheets, the sheets for all the groups accessible to the user may be discharged immediately after the user has been authenticated, without the selection screen being displayed in S605 in FIG. 13.

Modifications

In the exemplary embodiments described above, group names are displayed so as to be arranged side by side horizontally, for illustrative but not limitative purposes. For example, group names may be arranged in parallel vertically.

In the exemplary embodiments described above, furthermore, the controller 302 is responsible for display switching control, for illustrative but not limitative purposes. For example, the sheet accommodating device control unit 304 may perform display switching control.

Figure 15:
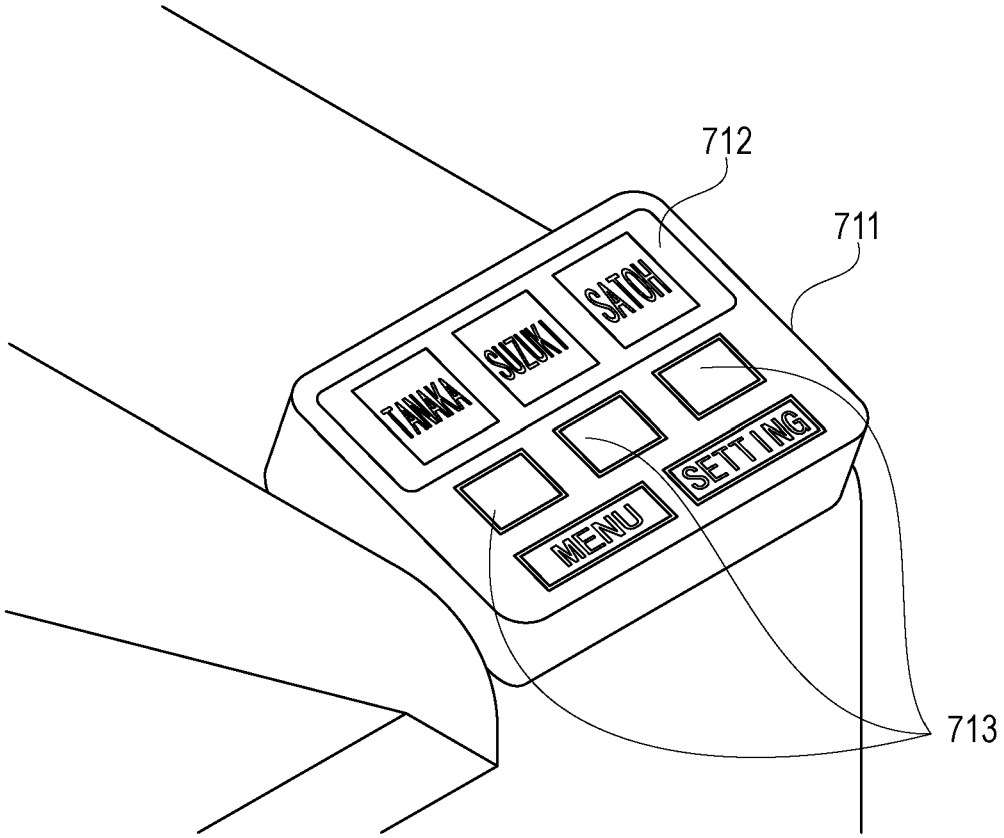
FIG. 15 is a diagram illustrating a configuration of an operation display unit according to a modification of the present invention.

In the exemplary embodiments described above, furthermore, the operation display unit 307 is implemented as a touch panel, for illustrative but not limitative purposes. For example, as illustrated in FIG. 15, an operation display unit 711 may be provided with a liquid crystal display 712, and hard switches 713 may be disposed below group names displayed on the operation display unit 711, so that a user can press one of the hard switches 713 to give instructions to discharge a sheet.

In the exemplary embodiments described above, furthermore, when the sheet accommodating device 200 is in use, the menu screen of the operation display unit 307 is switched to the selection screen or to the authentication screen, for illustrative but not limitative purposes. For example, the following configuration may be used: The menu screen of the operation display unit 307 is not switched, and a screen having no user selection buttons 325 is continuously displayed. Then, at the time when a certain user (SUZUKI) gives image forming instructions, the user selection button or buttons 325 illustrated in FIG. 6B, 6C, or 6D are additionally displayed.

In the exemplary embodiments described above, when the sheet accommodating device 200 is in use, the menu screen on the operation display unit 307 is instantly switched to the selection screen or to the authentication screen, for illustrative but not limitative purposes. For example, in a configuration in which the menu screen can be switched to the selection screen or to the authentication screen in response to a user performing an operation a plurality of times on the operation display unit 307 (e.g., in the case of a display menu having a multi-layer structure), it is effective to reduce the number of times the operation is performed when the sheet accommodating device 200 is in use. Specifically, a shortcut button (not illustrated) to the selection screen or to the authentication screen may be displayed on the menu screen. Pressing the shortcut button once allows a user to remove a sheet from the sheet accommodating device 200, without performing an operation a plurality of times on the menu screen, to display the selection screen or the authentication screen. Thus, usability may be improved.

In addition, the definitions as to whether or not the sheet accommodating device 200 is in use is not limited to those described in the exemplary embodiments described above. It may be determined that the sheet accommodating device 200 becomes in use at the time when the sheet accommodating device 200 is notified of image forming instructions to accommodate a sheet. It may also be determined that the sheet accommodating device 200 becomes in use at the time when, for example, a reservation to use the sheet accommodating device 200 later is made, or at the time when a group is assigned in the sheet accommodating device 200. It may also be determined that the sheet accommodating device 200 becomes in use at the time when instructions to start printing a sheet is issued to the sheet accommodating device 200, or at the time when accommodation of a sheet in the sheet accommodating device 200 is completed. It may also be determined that the sheet accommodating device 200 is in use, after any of the times described above, until all the operations have been canceled such as until the assignment of a group and the reservation for the sheet accommodating device 200 are canceled. The time when accommodation of a sheet in the sheet accommodating device 200 is completed may be defined as the time when a sensor (not illustrated) disposed near the sheet conveying port detects the trailing end of the sheet corresponding to the last page. It may also be determined that the sheet accommodating device 200 becomes in use at the time when any of the sheet presence sensors 231 to 233 detects a sheet. In addition, It may be determined that the sheet accommodating device 200 becomes in use at the time when a sensor (not illustrated) disposed in a sheet conveying path from the supply cassette 106 to the sheet accommodating device 200 detects a sheet. It may also be determined that the sheet accommodating device 200 becomes in use at the time when a timer (not illustrated) determines that a predetermined time has elapsed since a sheet accommodated in the sheet accommodating device 200 was supplied from the supply cassette 106. Accordingly, whether or not the sheet accommodating device 200 is in use is determined on condition that image forming instructions to accommodate a sheet in the sheet accommodating device 200 have been received.

Figure 16:
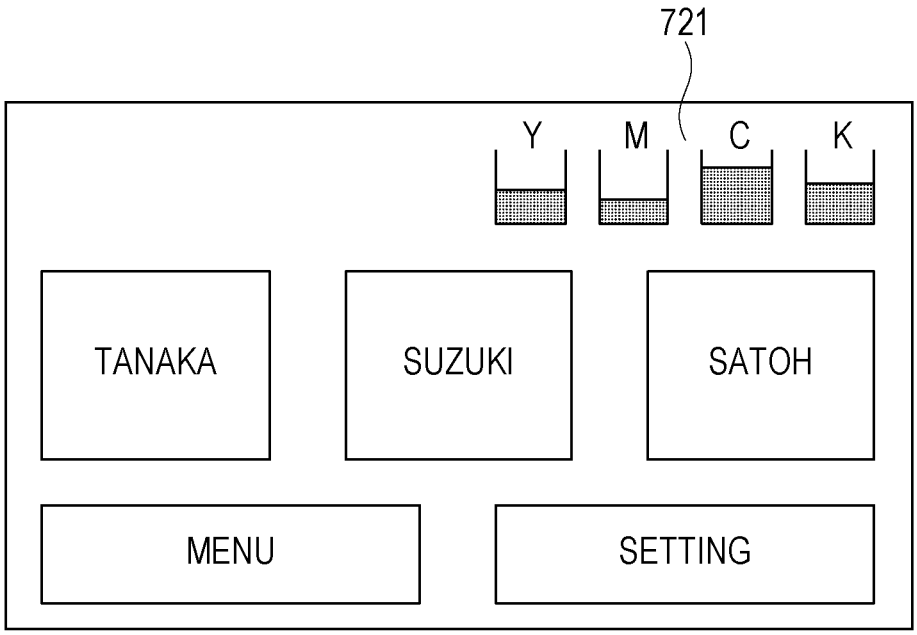
FIG. 16 is a diagram illustrating a screen of an operation display unit according to a modification of the present invention.

In the exemplary embodiments described above, furthermore, only a group name, a MENU button, and a SETTING button are displayed on the operation display unit 307 while the sheet accommodating device 200 is in use, for illustrative but not limitative purposes. For example, as illustrated in FIG. 16, a small portion 721 or the like may be provided in part of the screen to represent the state of the image forming apparatus 100.

In the exemplary embodiments described above, furthermore, only an accommodation unit in use is displayed on the selection screen, for illustrative but not limitative purposes. For example, even while one of the accommodation units 201, 202, and 203 is in use, three frames may be displayed on the selection screen, and a user name or a group name may be displayed in one of the three frames.

Figure 17:
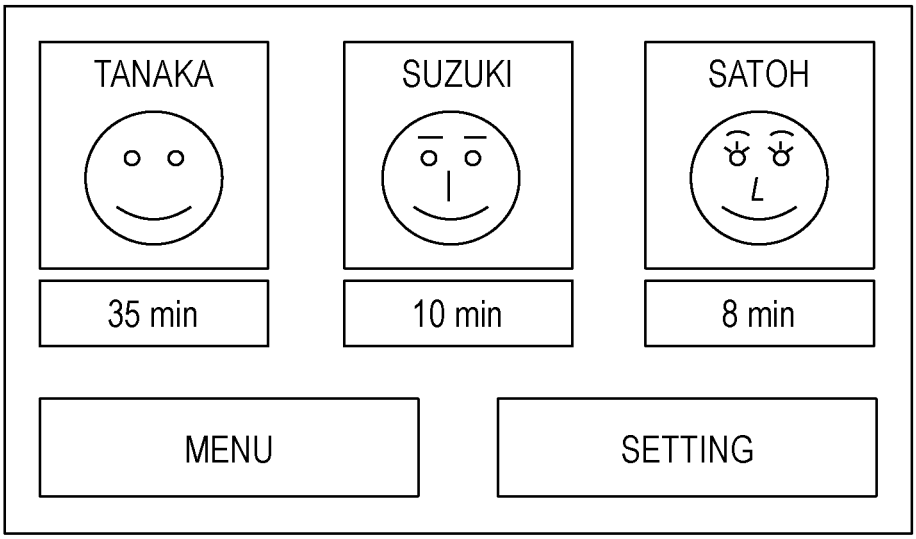
FIG. 17 is a diagram illustrating a screen of an operation display unit according to a modification of the present invention.

In the exemplary embodiments described above, furthermore, a group name or group names are displayed on the selection screen, for illustrative but not limitative purposes. As illustrated in FIG. 17, for example, a picture of a user's face, an illustration, a sign, or the like may be displayed. Additionally or alternatively, the time period during which the sheet accommodating device 200 is being used or the time period that has elapsed since the last time a sheet was accommodated in the sheet accommodating device 200 may be displayed. This may urge a person who occupies the sheet accommodating device 200 for a long time to discharge their sheet.

In the exemplary embodiments described above, furthermore, since a separate actuator is provided for each of the sheet moving units 241 to 243 in the accommodation units 201 to 203, the actuators can be simultaneously driven to expose sheets accommodated in the accommodation units 201 to 203 so that the sheets are laid on top of one another. Alternatively, a number of actuators less than the number of accommodation units may be provided. In this case, for example, a drive transmission switching mechanism such as a clutch (not illustrated) may be provided to selectively move a plurality of sheet moving units by using a single actuator.

In the exemplary embodiments described above, furthermore, the memory 305 includes the controller 302. Alternatively, the memory 305 may be included in the engine control unit 303 or the sheet accommodating device control unit 304, or may be included as an independent unit in the image forming apparatus control unit 301.

In the exemplary embodiments described above, furthermore, the engine control unit 303 and the sheet accommodating device control unit 304 are configured as separate components. Alternatively, the engine control unit 303 and the sheet accommodating device control unit 304 may be collectively configured as a component. In this case, the engine control unit 303 may control the conveying unit 105 and the sheet accommodating device 200.

In the exemplary embodiments described above, furthermore, the description has been given of a configuration in which sheet conveying paths merge downstream of the accommodation units 201 to 203 and a single opening (e.g., the opening 250) is provided. Alternatively, a plurality of openings may be separately provided. In this case, a sheet accommodated in each accommodation unit may be exposed from a separate opening.

In the exemplary embodiments described above, furthermore, the description has been given of a configuration in which three accommodation units are provided. The number of accommodation units is not limited to three. The number of accommodation units may be determined in accordance with the environment in which the main body of the image forming apparatus 100 is used, the number of users who share the main body of the image forming apparatus 100, or the specifications of the main body of the image forming apparatus 100.

In the exemplary embodiments described above, furthermore, the description has been given of a configuration in which the sheet accommodating device 200 is integrally formed with the image forming apparatus 100, by way of example. Alternatively, the sheet accommodating device 200 may be configured to be removably attachable to the image forming apparatus 100. In this case, a control unit provided in the image forming apparatus 100 may control the operation of the sheet accommodating device 200. Alternatively, the sheet accommodating device 200 may include an independent control unit, and the control unit may communicate with a control unit provided in the image forming apparatus 100 to control the operation of the image forming apparatus 100. In addition, the operation display unit 307 may be provided in the sheet accommodating device 200.

In the exemplary embodiments described above, an image forming apparatus has been described in the context of a laser beam printer, for illustrative but not limitative purposes. An embodiment of the present invention may provide a printer or a copying machine of any other printing method, such as an inkjet printer.

Figure 18:
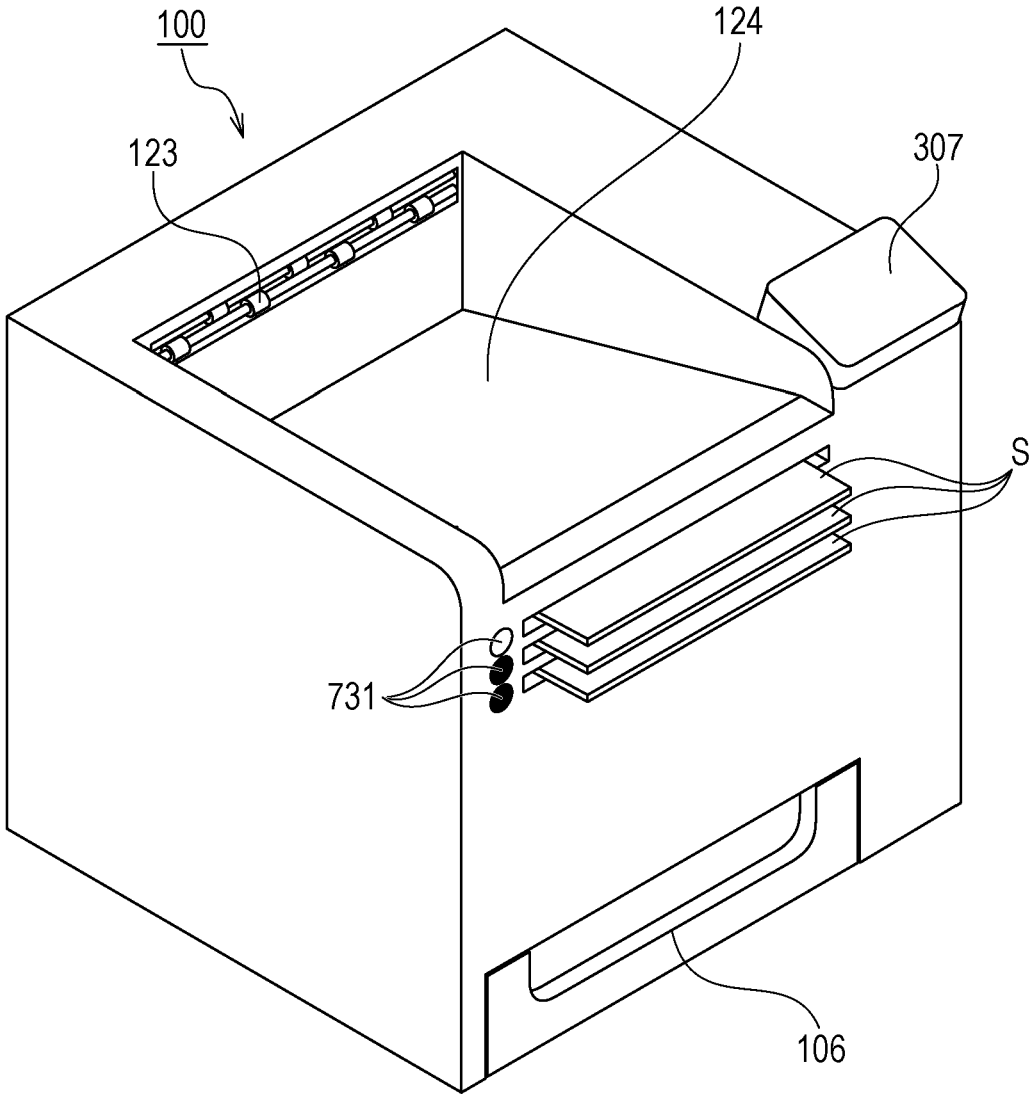
FIG. 18 is a perspective view of an image forming apparatus according to a modification of the present invention.
Figure 19:
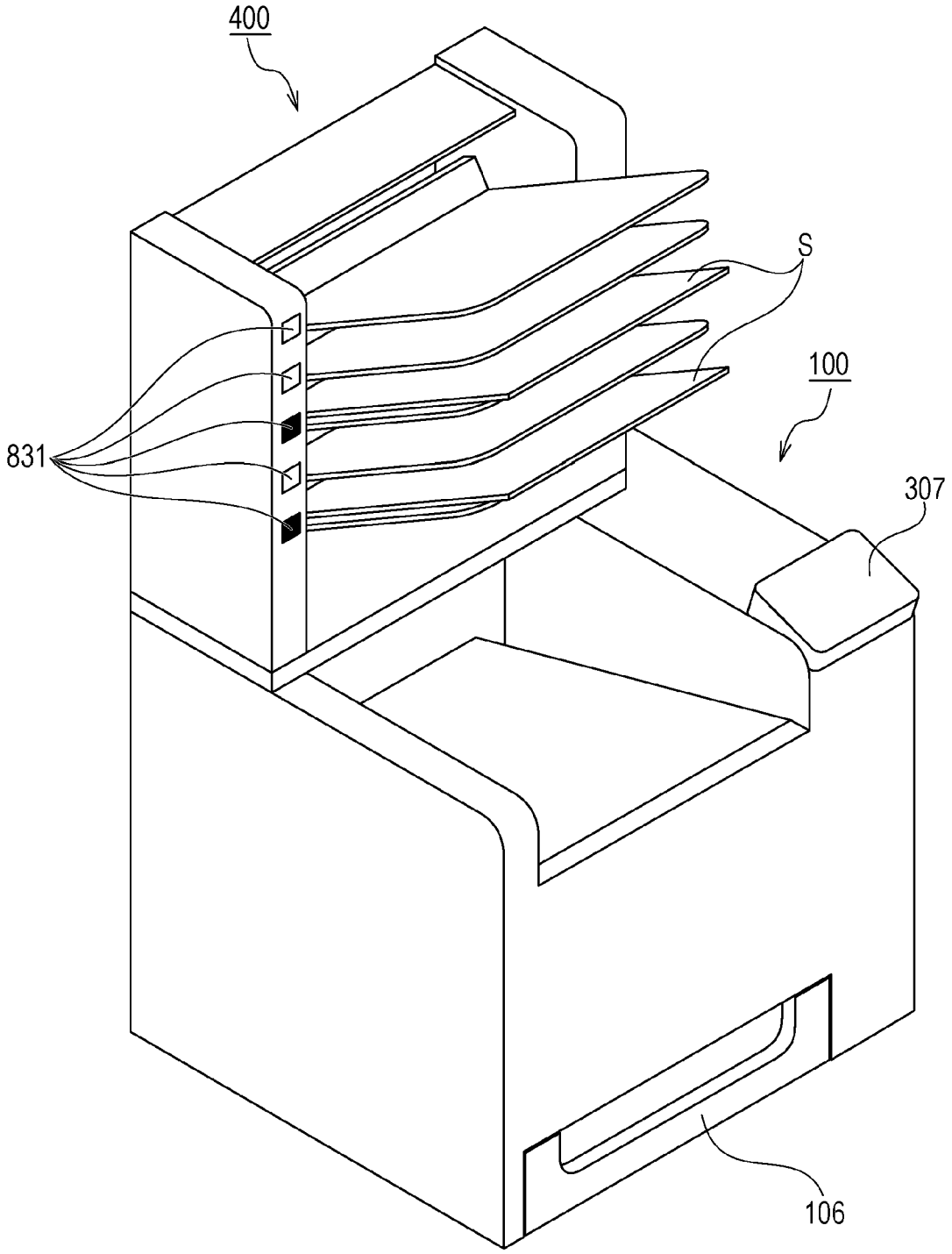
FIG. 19 is a perspective view of an image forming apparatus and a sheet accommodating device according to a modification of the present invention.

In the first exemplary embodiment described above, a portion of a sheet is exposed from the opening 250 in accordance with discharge instructions given by a user. However, embodiments of the present invention are not limited to that configuration. In an embodiment, the following configuration may be used: A user identifies a sheet to be removed among the sheets, parts of which are exposed from the opening 250. In a specific configuration, for example, a light-emitting diode (LED) may be turned on. FIG. 18 is a diagram illustrating a configuration of a main body. A portion of a sheet accommodated in the sheet accommodating device 200 has been exposed from the opening 250 to allow a user to remove the sheet at the time when the accommodation of the sheet is completed. In order to remove a sheet, first, the user gives discharge instructions on a selection screen on the operation display unit 307. The configuration of the selection screen is similar to that in the exemplary embodiments described above, and is not described again. After the user gives discharge instructions, only an LED 731 for an accommodation unit associated with the given instructions among LEDs 731 provided for the accommodation units is turned on to allow the user to identify the sheet to be removed. In FIG. 18, a portion of a sheet is exposed from the opening 250, for illustrative but not limitative purposes. As illustrated in FIG. 19, a sheet accommodating device 400 that allows the user to visually check an entire sheet accommodated in the sheet accommodating device 400 may be disposed above the image forming apparatus 100. In this case, each accommodation unit is provided with an LED 831. After a user gives discharge instructions, only an LED 831 of the accommodation unit associated with the given discharge instructions among the LEDs 831 is turned on to allow the user to identify the sheet to be removed.

Figure 20:
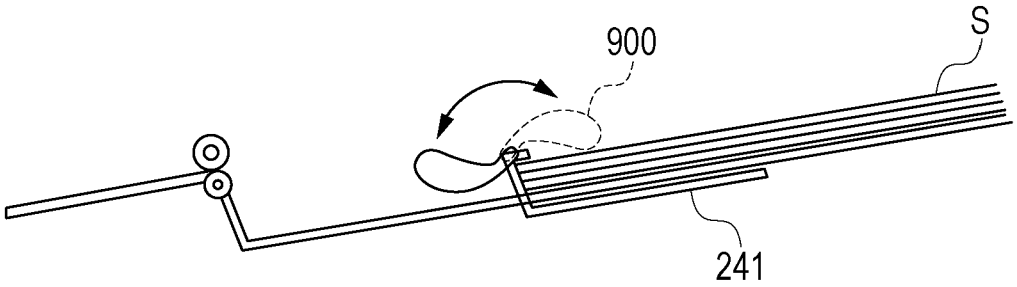
FIG. 20 is a diagram illustrating a configuration of a holding unit according to a modification of the present invention.

In addition, the configuration illustrated in FIG. 18 may be applied to the second and third exemplary embodiments. In this case, a configuration in which the user is able to remove a sheet exposed from the opening 250 without performing user authentication will not be suitable in terms of information confidentiality. Thus, as illustrated in FIG. 20, the sheet moving unit 241 is provided with a holding unit 900. The holding unit 900 is movable to either a retracting position indicated by a solid line or a holding position indicated by a broken line, and is configured to press and hold the trailing end of a sheet S at the holding position. While the holding unit 900 presses and holds the trailing end of a sheet S, the user is not allowed to remove the sheet. Accordingly, in the configuration illustrated in FIG. 18, the holding unit 900 is positioned at the holding position to prevent the user from removing a sheet from the opening 250 until the user has been successfully authenticated. After the user has been successfully authenticated, the LED 731 for the accommodation unit associated with the given discharge instructions is turned on, and the associated holding unit 900 is moved to the retracting position.

In the first and second exemplary embodiments described above, sheets having the same user information are collectively exposed from the opening 250. As in the third exemplary embodiment, sheets may collectively be exposed for each department or team to which a user belongs. In addition, when a user gives printing instructions, the user may be able to set whether the associated information is personal information that is kept secret from other people or information the user wishes to share with their team members. In this case, for example, it is assumed that a certain user A gives printing instructions and a sheet having an image formed thereon is conveyed to the sheet accommodating device 200. In this case, even a member of the team to which the user A belongs is not allowed to remove a sheet that is set to be a sheet for personal information from the sheet accommodating device 200. In contrast, a sheet that is set to be a sheet for team shared information can be removed from the sheet accommodating device 200 by a member of the team to which the user A belongs.

In the second and third exemplary embodiments described above, authentication information on each user may be stored in the memory 305 in advance. This may not require the user to set authentication information each time they give image forming instructions. The user may only be required to input authentication information to the operation display unit 307 only when giving instructions to discharge a sheet.

In the second and third exemplary embodiments described above, furthermore, a user authentication process is performed by a user by entering authentication information on the authentication screen displayed on the operation display unit 307. However, embodiments of the present invention are not limited to the configuration described in the second and third exemplary embodiments. In an embodiment, for example, a user may perform user authentication only by inserting their own ID card into a card slot (not illustrated) provided in the image forming apparatus 100. In this case, a message that prompts a user to insert an ID card is displayed on the operation display unit 307.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-260386, filed Dec. 17, 2013, which is hereby incorporated by reference herein in its entirety.

What is claimed is:

1. An image forming apparatus comprising:

a main body formed with an opening;

an image forming unit configured to form an image on a sheet;

an accommodation unit configured to accommodate, inside the main body, the sheet on which the image has been formed by the image forming unit;

a sheet moving unit configured to move the sheet accommodated in the accommodation unit until the sheet is exposed to outside the main body via the opening;

a display unit configured to display a screen; and a controller configured to switch the screen of the display unit, wherein, in a case where an instruction is received from a user to accommodate a sheet in the accommodation unit, the controller switches the screen of the display unit from a predetermined screen to a selection screen which displays information concerning the user giving the instruction to accommodate the sheet in the accommodation unit and the controller causes the accommodation unit to accommodate the sheet, wherein, in a case where the information has been selected on the selection screen, the sheet moving unit moves a sheet of the user associated with the selected information until the sheet is exposed to outside the main body via the opening and the controller determines whether the accommodation unit is in use, wherein, in a case where the controller determines that the accommodation unit is in use, the controller causes the display unit to display the selection screen, and wherein, in a case where the controller determines that the accommodation unit is not in use, the controller causes the display unit to display the predetermined screen.

2. The image forming apparatus according to claim 1, wherein, after the information has been selected on the selection screen and before the sheet moving unit moves the sheet, the controller switches the screen of the display unit from the selection screen to an authentication screen for authenticating the user to determine whether the user is authorized to expose the sheet of the user associated with the information selected on the selection screen to outside the main body, and wherein, in a case where the user is successfully authenticated on the authentication screen, the sheet moving unit moves the sheet of the user associated with the information selected on the selection screen until the sheet is exposed to outside the main body via the opening and the controller determines whether the accommodation unit is in use.

3. The image forming apparatus according to claim 1, wherein the selection screen represents information concerning a name of the user who has given the received instruction.

4. The image forming apparatus according to claim 1, wherein the selection screen represents information concerning a name of a group to which the user, who has given the received instruction, belongs.

5. The image forming apparatus according to claim 1, wherein the controller switches the screen of the display unit from the predetermined screen to the selection screen at a time when the instruction is received.

6. The image forming apparatus according to claim 1, wherein the controller switches the screen of the display unit from the predetermined screen to the selection screen at a time when formation of an image on a sheet is started in accordance with the instruction.

7. The image forming apparatus according to claim 1, wherein the controller switches the screen of the display unit from the predetermined screen to the selection screen at a time when accommodation of a sheet, in the accommodation unit and on which an image has been formed in accordance with the instruction, is completed.

8. The image forming apparatus according to claim 1, wherein the sheet moving unit moves the sheet accommodated in the accommodation unit and stops the sheet in an exposure state such that a part of the sheet is exposed to outside the main body via the opening.

9. The image forming apparatus according to claim 1, wherein the predetermined screen is a screen that represents a state or function of the image forming apparatus.

10. The image forming apparatus according to claim 1, wherein the instruction to accommodate the sheet is an image forming instruction to form an image on the sheet.

11. The image forming apparatus according to claim 1, wherein, after the sheet of the user associated with the selected information has been removed from the main body and in a case where the controller determines that the accommodation unit is in use, the controller removes the information concerning the user giving the instruction to accommodate the sheet in the accommodation unit and maintains displaying information concerning the users of the accommodation unit so that only an accommodation unit in use is displayed on the selection screen.

12. The image forming apparatus according to claim 11, wherein the controller determines that the accommodation unit is in use during a period from a time when image forming instructions are issued to the accommodation unit to accommodate a sheet to a time when sheets in each accommodation unit have been removed by a user and, during the other period, the controller determines that the accommodation unit is not in use.

13. The image forming apparatus according to claim 1, wherein the predetermined screen is one of a menu screen and an authentication screen.

14. The image forming apparatus according to claim 1, wherein, in the case where the information has been selected on the selection screen, the controller switches the screen of the display unit from the selection screen to a discharge screen.

15. A sheet accommodating device comprising:

a main body formed with an opening;

an accommodation unit configured to accommodate, inside the main body, a sheet having an image formed thereon;

a sheet moving unit configured to move the sheet accommodated in the accommodation unit until the sheet is exposed to outside the main body via the opening;

a display unit configured to display a screen; and a controller configured to switch the screen of the display unit, wherein, in a case where an instruction is received from a user to accommodate a sheet in the accommodation unit, the controller switches the screen of the display unit from a predetermined screen to a selection screen which displays information concerning the user giving the instruction to accommodate the sheet in the accommodation unit and the controller causes the accommodation unit to accommodate the sheet, wherein, in a case where the information has been selected on the selection screen, the sheet moving unit moves a sheet of the user associated with the selected information until the sheet is exposed to outside the main body via the opening and the controller determines whether the accommodation unit is in use, wherein, in a case where the controller determines that the accommodation unit is in use, the controller causes the display unit to display the selection screen, and wherein, in a case where the controller determines that the accommodation unit is not in use, the controller causes the display unit to display the predetermined screen.

* * * * *